US012366048B2

(12) United States Patent
Izumikawa

(10) Patent No.: US 12,366,048 B2
(45) Date of Patent: Jul. 22, 2025

(54) SHOVEL AND CONSTRUCTION SYSTEM

(71) Applicant: SUMITOMO CONSTRUCTION MACHINERY CO., LTD., Tokyo (JP)

(72) Inventor: Takeya Izumikawa, Chiba (JP)

(73) Assignee: SUMITOMO CONSTRUCTION MACHINERY CO., LTD., Tokyo (JP)

( * ) Notice: Subject to any disclaimer, the term of this patent is extended or adjusted under 35 U.S.C. 154(b) by 969 days.

(21) Appl. No.: 17/448,948

(22) Filed: Sep. 27, 2021

(65) Prior Publication Data

US 2022/0010519 A1 Jan. 13, 2022

Related U.S. Application Data

(63) Continuation of application No. PCT/JP2020/014231, filed on Mar. 27, 2020.

(30) Foreign Application Priority Data

Mar. 28, 2019 (JP) ..... 2019-065022

(51) Int. Cl.
*E02F 3/43* (2006.01)
*E02F 9/20* (2006.01)
*E02F 9/22* (2006.01)

(52) U.S. Cl.
CPC ..... *E02F 3/43* (2013.01); *E02F 9/2004* (2013.01); *E02F 9/22* (2013.01)

(58) Field of Classification Search
None
See application file for complete search history.

(56) References Cited

U.S. PATENT DOCUMENTS

| | | | | |
|---|---|---|---|---|
| 9,493,929 | B2 | 11/2016 | Kurihara et al. | |
| 10,619,326 | B2 | 4/2020 | Hita et al. | |
| 10,801,187 | B2 * | 10/2020 | Izumi | E02F 9/265 |
| 10,961,690 | B2 | 3/2021 | Chiba et al. | |
| 2017/0089033 | A1 * | 3/2017 | Matsuyama | E02F 9/2285 |
| 2017/0298592 | A1 * | 10/2017 | Akanda | E02F 3/304 |

FOREIGN PATENT DOCUMENTS

| | | |
|---|---|---|
| CN | 108797669 | 11/2018 |
| JP | 2014-101664 | 6/2014 |
| JP | 2018-003388 | 1/2018 |
| JP | 2018-172858 | 11/2018 |
| WO | 2019/053833 | 3/2019 |

OTHER PUBLICATIONS

International Search Report for PCT/JP2020/014231 mailed on Jun. 23, 2020.

* cited by examiner

*Primary Examiner* — James J Lee
*Assistant Examiner* — Elizabeth Galyn Martinez
(74) *Attorney, Agent, or Firm* — IPUSA, PLLC

(57) ABSTRACT

A shovel includes a traveling lower body; a revolving upper body installed on the traveling lower body, to be capable of revolving; an attachment attached to the revolving upper body; an end attachment constituting the attachment; an actuator; and a control device including a memory and a processor configured to cause the actuator to operate autonomously. The control device calculates a control value of the actuator for each of a plurality of predetermined points on the end attachment, and based on the calculated control values, causes the actuator to operate autonomously.

13 Claims, 17 Drawing Sheets

SHOVEL AND CONSTRUCTION SYSTEM

CROSS-REFERENCE TO RELATED APPLICATION

The present application is a continuation application of International Application No. PCT/JP2020/014231 filed on Mar. 27, 2020, which is based on and claims priority to Japanese Patent Application No. 2019-065022, filed on Mar. 28, 2019. The contents of these applications are incorporated herein by reference in their entirety.

BACKGROUND

Technical Field

The present disclosure relates to a shovel as an excavation machine, and a construction system.

Description of Related Art

Conventionally, a shovel has been known that calculates, when an operator manually operates an operation device to perform slope face finishing work while moving a boom; an arm; and a bucket, a distance (shortest distance) between a target surface and a part closest to the target surface from among the parts of the bucket, and displays the distance.

This shovel is configured to output a warning sound based on the shortest distance between the bucket and the target surface. Specifically, the shovel is configured to make the frequency of the warning sound higher as the shortest distance becomes shorter, to let the operator of the shovel recognize that the bucket comes too close to the target surface.

However, in the shovel described above, the warning sound does not change in the case where the teeth end of the bucket is located on the target surface, namely, in the case where the shortest distance is zero. Therefore, as long as this condition continues, the operator of the shovel may be likely to recognize that the teeth end of the bucket is detected as the part closest to the target surface.

As a result, in a situation where the tilt angle of the target surface becomes greater as the distance from the shovel becomes greater, when opening the arm while having the teeth end of the bucket contact the target surface, the shovel described above may cause the back face of the bucket to contact the target surface, and damage the target surface. This is because the operator cannot recognize that the back face of the bucket has come close to the tilted surface even if the tilted surface as part of the target surface comes close to the back face of the bucket.

SUMMARY

According to an embodiment of the present disclosure, a shovel includes a traveling lower body; a revolving upper body installed on the traveling lower body, to be capable of revolving; an attachment attached to the revolving upper body; an end attachment constituting the attachment; an actuator; and a control device including a memory and a processor configured to cause the actuator to operate autonomously. The control device calculates a control value of the actuator for each of a plurality of predetermined points on the end attachment, and based on the calculated control values, causes the actuator to operate autonomously.

DETAILED DESCRIPTION

According to an embodiment, a shovel with which damage of a target surface caused by an end attachment can be prevented more securely, is provided.

Figure 1:
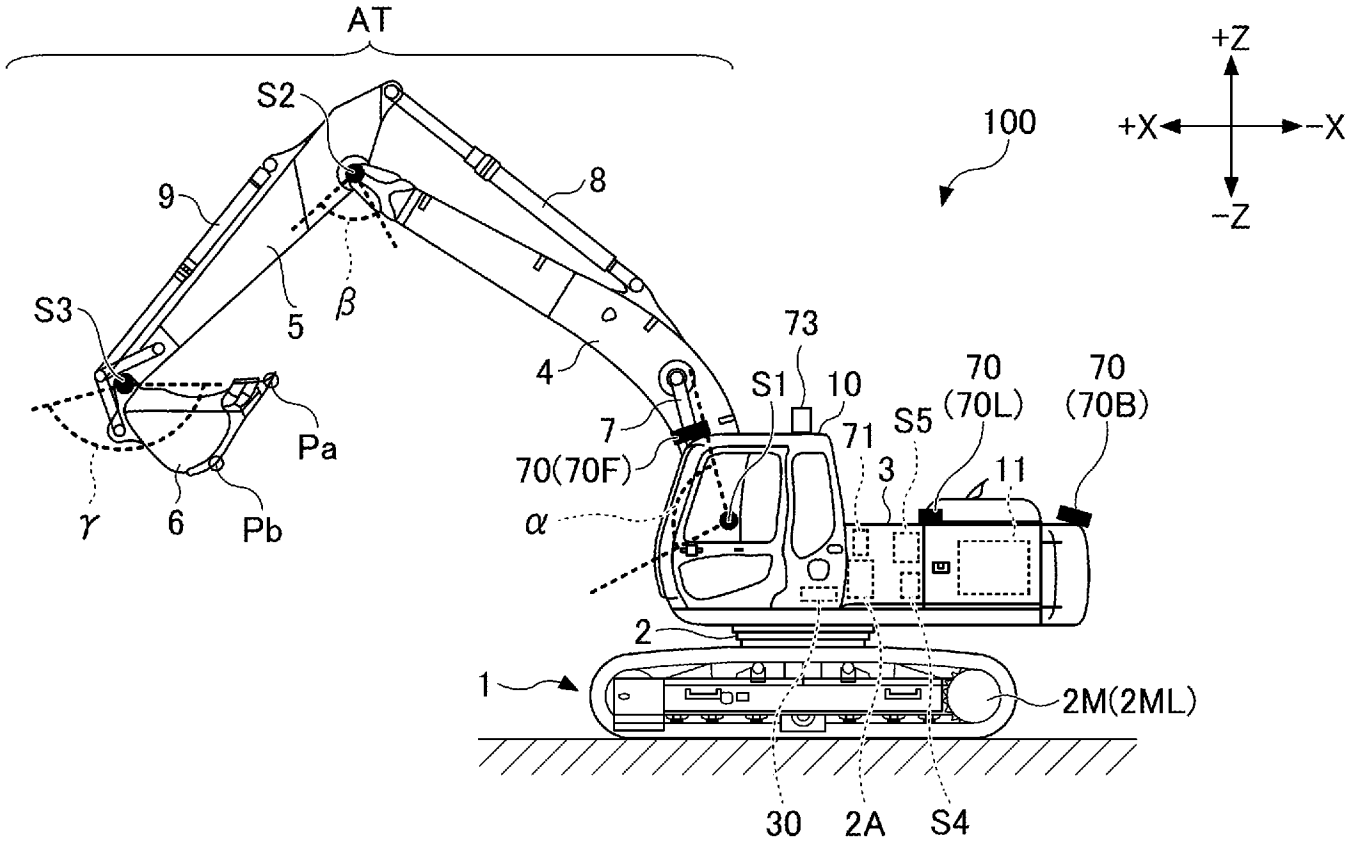
FIG. 1 is a side view of a shovel according to an embodiment in the present disclosure.
Figure 2:
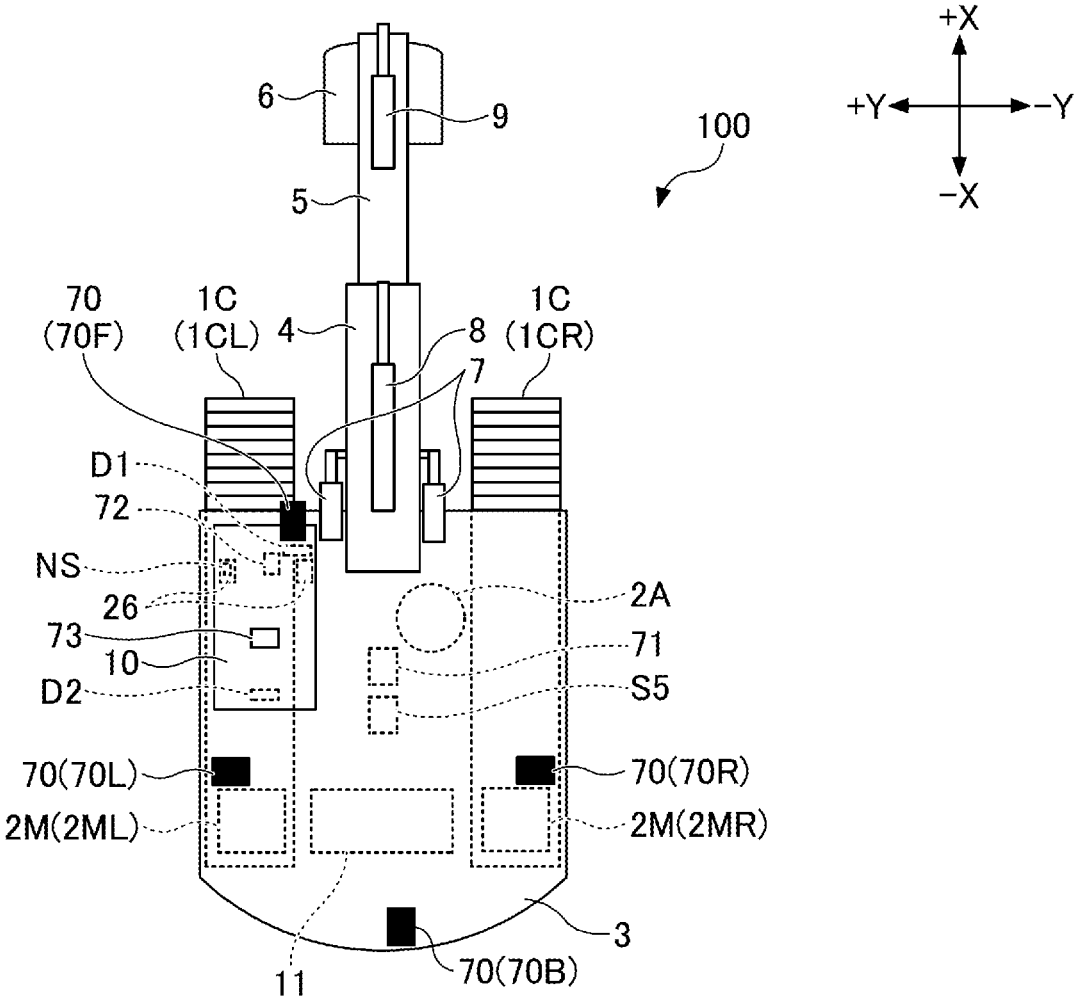
FIG. 2 is a top view of the shovel in FIG. 1.

First, with reference to FIG. 1 and FIG. 2, a shovel 100 as an excavation machine according to an embodiment in the present disclosure will be described. FIG. 1 is a side view of the shovel 100; and FIG. 2 is a top view of the shovel 100.

In the present embodiment, a traveling lower body 1 of the shovel 100 includes crawlers 1C. The crawlers 1C are driven by hydraulic motors for traveling 2M as an actuator installed in the traveling lower body 1. Specifically, the crawlers 1C include a left crawler 1CL and a right crawler 1CR. The left crawler 1CL is driven by a left hydraulic motor for traveling 2ML and the right crawler 1CR is driven by a right hydraulic motor for traveling 2MR.

On the traveling lower body 1, a revolving upper body 3 is installed, which can be revolved by a revolution mechanism 2. The revolution mechanism 2 is driven by a hydraulic motor for revolution 2A as an actuator installed in the revolving upper body 3. However, the actuator for revolution may be a motor-generator for revolution as an electric actuator.

A boom 4 is attached to the revolving upper body 3. An arm 5 is attached to the tip of the boom 4, and a bucket 6 as an end attachment is attached to the tip of the arm 5. The boom 4, the arm 5, and the bucket 6 constitute an excavation attachment AT as an example of an attachment. The boom 4 is driven by a boom cylinder 7, the arm 5 is driven by an arm cylinder 8, and the bucket 6 is driven by a bucket cylinder 9. The boom cylinder 7, the arm cylinder 8, and the bucket cylinder 9 constitute an attachment actuator. The end attachment may be a slope face bucket.

The boom 4 is supported to be rotatably movable up and down with respect to the revolving upper body 3. In addition, the boom 4 has a boom angle sensor S1 attached. The boom angle sensor S1 can detect a boom angle α as an angle of rotation of the boom 4. For example, the boom angle α is the angle of elevation from a state of the boom 4 being descended most. Therefore, the boom angle α becomes maximum when the boom 4 comes to the highest position.

The arm 5 is supported to be rotatably movable with respect to the boom 4. In addition, the arm 5 has an arm angle sensor S2 attached. The arm angle sensor S2 can detect an arm angle β as an angle of rotation of the arm 5. For example, the arm angle β is the angle of opening from a state of the arm 5 being closed most. Therefore, the arm angle β becomes maximum when the arm 5 is opened to the maximum.

The bucket 6 is supported to be rotatably movable with respect to the arm 5. In addition, the bucket 6 has a bucket angle sensor S3 attached. The bucket angle sensor S3 can detect a bucket angle γ as an angle of rotation of the bucket 6. The bucket angle γ is the angle of opening from a state of the bucket 6 being closed most. Therefore, the bucket angle γ becomes maximum when the bucket 6 is opened most.

In the embodiment in FIG. 1, each of the boom angle sensor S1, the arm angle sensor S2, and the bucket angle sensor S3 is configured as a combination of an acceleration sensor and a gyro sensor. However, it may be constituted only with an acceleration sensor. Also, the boom angle sensor S1 may be a stroke sensor attached to the boom cylinder 7, or may be a rotary encoder, potentiometer, inertial measuring device, or the like. The same applies to the arm angle sensor S2 and the bucket angle sensor S3.

The revolving upper body 3 is provided with a cabin 10 as the driver's cab, and has a power source such as an engine 11 installed. Also, a space recognition device 70, an orientation detection device 71, a positioning device 73, a machine tilt sensor S4, a revolutional angular velocity sensor S5, and the like are attached to the revolving upper body 3. An operation device 26, a controller 30, an information input device 72, a display device D1, and a voice output device D2, and the like are provided in the interior of the cabin 10. Note that in the present description, for the sake of convenience, a side of the revolving upper body 3 on which the excavation attachment AT is attached is defined as the forward direction, and a side on which the counterweight is attached is defined as the backward direction.

The space recognition device 70 is configured to recognize objects present in a three-dimensional space in the surroundings of the shovel 100. Also, the space recognition device 70 may be configured to calculate the distance from the space recognition device 70 or the shovel 100 to a recognized object. The space recognition device 70 includes, for example, an ultrasonic sensor, a millimeter-wave radar, a monocular camera, a stereo camera, a LIDAR, a distance image sensor, an infrared sensor, or the like; or any combination of these. In the present embodiment, the space recognition device 70 includes a forward sensor 70F attached to the front end of the top surface of the cabin 10; a backward sensor 70B attached to the rear end of the top surface of the revolving upper body 3; a leftward sensor 70L attached to the left end of the top surface of the revolving upper body 3; and a rightward sensor 70R attached to the right end of the top surface of the revolving upper body 3. An upward sensor to recognize objects present in a space above the revolving upper body 3 may be attached to the shovel 100.

The orientation detection device 71 is configured to detect information on the relative relationship between the orientation of the revolving upper body 3 and the orientation of the traveling lower body 1. The orientation detection device 71 may be constituted with, for example, a combination of a geomagnetic sensor attached to the traveling lower body 1 and a geomagnetic sensor attached to the revolving upper body 3. Alternatively, the orientation detection device 71 may be constituted with a combination of a GNSS receiver attached to the traveling lower body 1 and a GNSS receiver attached to the revolving upper body 3. The orientation detection device 71 is a rotary encoder, rotary position sensor, or the like; or may be any combination of these. In a configuration where the revolving upper body 3 is driven to perform revolutions by a motor generator for revolutions, the orientation detection device 71 may be constituted with a resolver. The orientation detection device 71 may be attached to, for example, a center joint provided in connection with the revolution mechanism 2 to implement relative revolution between the traveling lower body 1 and the revolving upper body 3.

The orientation detection device 71 may also be constituted with a camera attached to the revolving upper body 3. In this case, the orientation detection device 71 applies known image processing to an image captured by the camera attached to the revolving upper body 3 (an input image), to detect an image of the traveling lower body 1 included in the input image. In addition, by detecting an image of the traveling lower body 1 using a known image recognition technique, the orientation detection device 71 identifies the longitudinal direction of the traveling lower body 1, and then, derives an angle formed between the direction of the front-and-back axis of the revolving upper body 3 and the longitudinal direction of the traveling lower body 1. The direction of the front-and-back axis of the revolving upper body 3 is derived from the attached position of the camera. In particular, as the crawler 1C protrudes from the revolving upper body 3, by detecting an image of the crawler 1C, the orientation detection device 71 can identify the longitudinal direction of the traveling lower body 1. In this case, the orientation detection device 71 may be integrated into the controller 30. Also, the camera may be the space recognition device 70.

The information input device 72 is configured to allow the operator of the shovel to input information into the controller 30. In the present embodiment, the information input device 72 is a switch panel installed close to the display unit of the display device D1. However, the information input device 72 may be a touch panel arranged on the display unit of the display device D1, or may be a voice input device such as a microphone arranged in the cabin 10. Also, the information input device 72 may be a communication device that obtains information from the outside.

The positioning device 73 is configured to measure the position of the revolving upper body 3. In the present embodiment, the positioning device 73 is a GNSS receiver that detects the position of the revolving upper body 3, and outputs a detected value to the controller 30. The positioning device 73 may be a GNSS compass. In this case, the positioning device 73 can detect the position and the orientation of the revolving upper body 3, and hence, also functions as the orientation detection device 71.

The machine tilt sensor S4 detects the tilt of the revolving upper body 3 with respect to a predetermined plane. In the present embodiment, the machine tilt sensor S4 is an acceleration sensor to detect the tilt angle around the front-and-back axis and the tilt angle around the right-and-left axis of the revolving upper body 3 with respect to the horizontal plane. The front-and-back axis and the right-and-left axis of the revolving upper body 3 are, for example, orthogonal to each other, and pass through the center point of the shovel as a point along the pivot of the shovel 100.

The revolutional angular velocity sensor S5 detects the revolutional angular velocity of the revolving upper body 3. In the present embodiment, it is a gyro sensor, or may be a resolver, a rotary encoder, or the like; or any combination of these. The revolutional angular velocity sensor S5 may detect the revolutional velocity. The revolutional velocity may be calculated from the revolutional angular velocity.

In the following, at least one of the boom angle sensor S1, the arm angle sensor S2, the bucket angle sensor S3, the machine tilt sensor S4, and the revolutional angular velocity sensor S5 will be referred to as the position detection device(s). The position of the excavation attachment AT is detected based on, for example, the respective outputs of the boom angle sensor S1, the arm angle sensor S2, and the bucket angle sensor S3.

The display device D1 is a device to display information. In the present embodiment, the display device D1 is a liquid crystal display installed in the cabin 10. However, the display device D1 may be a display of a mobile terminal such as a smartphone.

The sound output device D2 is a device to output sound. The sound output device D2 includes at least one of a device to output sound to the operator in the cabin 10, and a device to output sound to a worker outside the cabin 10. It may be a speaker of a mobile terminal.

The operation device 26 is a device used by the operator for operating the actuators. The operation device 26 includes, for example, an operation lever and an operation pedal. The actuators include at least one of a hydraulic actuator and an electric actuator.

The controller 30 is a control device for controlling the shovel 100. In the present embodiment, the controller 30 is constituted with a computer that includes a CPU, a volatile memory device, a non-volatile memory device, and the like. Also, the controller 30 reads a program corresponding to various functions from the non-volatile memory device to load the program in the volatile memory device, and causes the CPU to execute the corresponding processing. The functions includes, for example, a machine guidance function that guides a manual operation of the shovel 100 performed by the operator; and a machine control function to assist a manual operation of the shovel 100 performed by the operator, or to cause the shovel 100 to operate automatically or autonomously. In order to avoid contact between an object present in a monitoring range in the surroundings of the shovel 100 and the shovel 100, the controller 30 may include a contact avoidance function to cause the shovel 100 to operate automatically or autonomously, or stop the shovel 100. Monitoring of objects in the surroundings of the shovel 100 is executed not only within the monitoring range but also outside the monitoring range. At this time, the controller 30 detects the type of an object and the position of the object.

Figure 3:
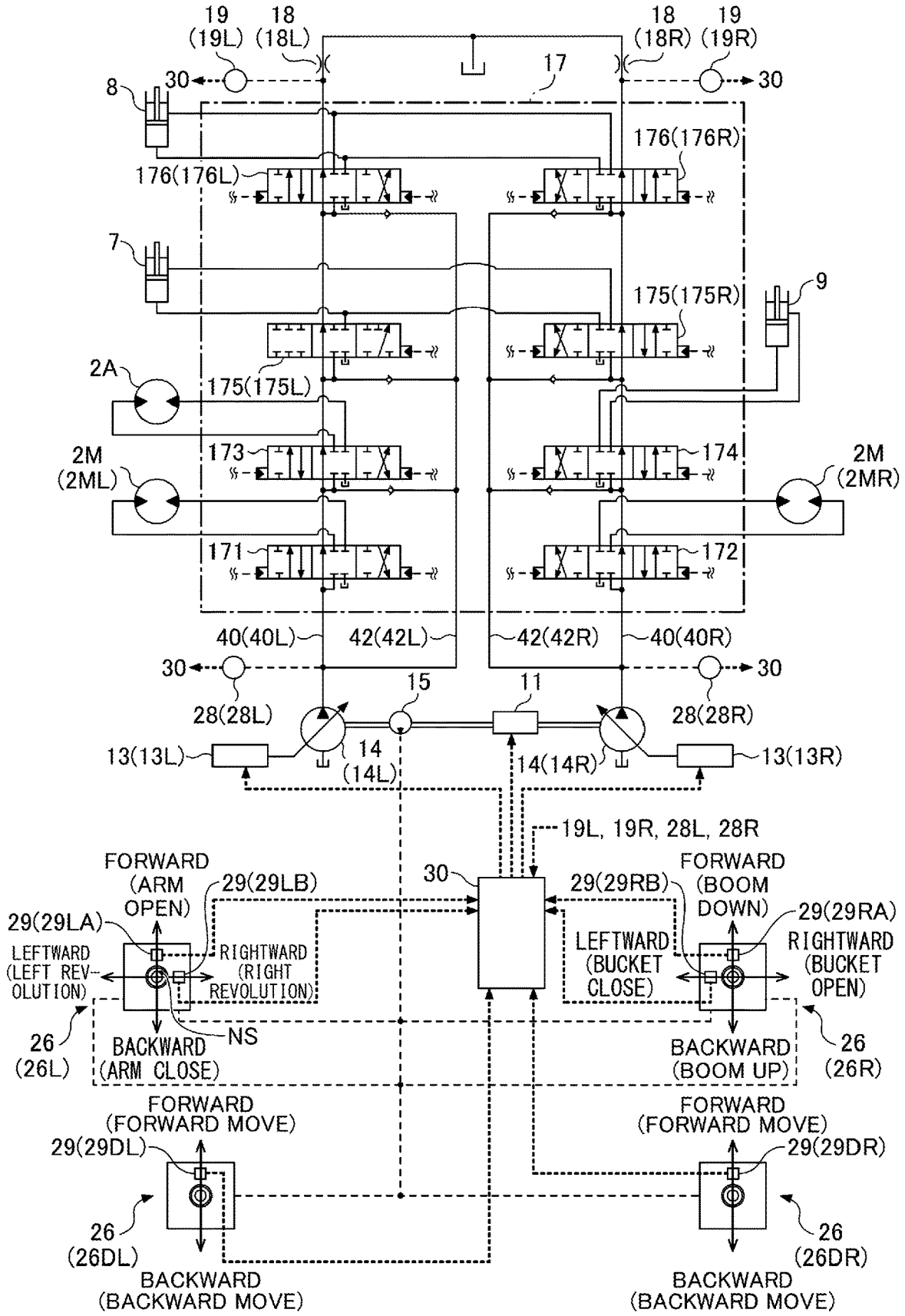
FIG. 3 is a diagram illustrating an example of a configuration of a hydraulic system installed in the shovel in FIG. 1.

Next, with reference to FIG. 3, an example of a configuration of a hydraulic system installed in the shovel 100 will be described. FIG. 3 is a diagram illustrating an example of a configuration of a hydraulic system installed in the shovel 100. In FIG. 3, a mechanical power transmission system, hydraulic oil lines, pilot lines, and an electrical control system are designated with double lines, solid lines, dashed lines, and dotted lines, respectively.

The hydraulic system of the shovel 100 primarily includes an engine 11, regulators 13, main pumps 14, a pilot pump 15, control valve unit 17, an operation device 26, discharge pressure sensors 28, operational pressure sensors 29, a controller 30, and the like.

In FIG. 3, the hydraulic system is configured to be capable of circulating hydraulic oil from the main pumps 14, which is driven by the engine 11, to the hydraulic oil tank via center bypass pipelines 40 or parallel pipelines 42.

The engine 11 is the driving source of the shovel 100. In the present embodiment, the engine 11 is, for example, a diesel engine that operates to maintain a predetermined number of revolutions. The output shaft of the engine 11 is coupled with the respective input shafts of the main pumps 14 and the pilot pump 15.

The main pump 14 is configured to be capable of supplying hydraulic oil to the control valve unit 17 via hydraulic oil lines. In the present embodiment, the main pump 14 is a swashplate-type, variable-capacity hydraulic pump.

The regulator 13 is configured to be capable of controlling the discharge amount of the main pump 14. In the present embodiment, according to a control command from the controller 30, the regulator 13 adjusts the tilt angle of the swashplate of the main pump 14, so as to control the discharge amount of the main pump 14.

The pilot pump 15 is an example of a pilot pressure generation device, and configured to be capable of supplying hydraulic oil to a hydraulic control device including the operation device 26 via the pilot lines. In the present embodiment, the pilot pump 15 is a fixed-capacity hydraulic pump. However, the pilot pressure generation device may be implemented by the main pump 14. In other words, in addition to the function of supplying hydraulic oil to the control valve unit 17 via the hydraulic oil line, the main pumps 14 may include a function of supplying hydraulic oil to the various oil pressure controlling devices including the operation device 26 via the pilot line. In this case, the pilot pump 15 may be omitted.

The control valve unit 17 is a hydraulic control device that control the hydraulic system in the shovel 100. In the present embodiment, the control valve unit 17 include control valves 171 to 176. The control valve 175 include a control valve 175L and a control valve 175R, and the control valve 176 include a control valve 176L and a control valve 176R. The control valve unit 17 is configured to be capable of selectively supplying hydraulic oil discharged by the main pumps 14 to one or more hydraulic actuators through the control valves 171 to 176. The control valves 171 to 176 control, for example, the flow rate of the hydraulic oil flowing from the main pumps 14 to the hydraulic actuators, and the flow rate of the hydraulic oil flowing from the hydraulic actuators to the hydraulic oil tank. The hydraulic actuators include the boom cylinder 7, the arm cylinder 8, the bucket cylinder 9, the left hydraulic motor for traveling 2ML, the right hydraulic motor for traveling 2MR, and the hydraulic motor for revolution 2A.

The operation device 26 is configured to be capable of supplying, via the pilot lines, hydraulic oil discharged by the pilot pump 15 to the pilot port of a corresponding control valve in the control valve unit 17. The pressure (pilot pressure) of the hydraulic oil supplied to each of the pilot ports is a pressure depending on the operational direction and the operational amount of a lever or pedal of the operation device 26 corresponding to each of the hydraulic actuators. However, the operation device 26 may be of an electrically controlled type, instead of a pilot pressure type as described above. In this case, each control valve in the control valve unit 17 may be an electromagnetic solenoid type spool valve.

The discharge pressure sensors 28 are configured to be capable of detecting the discharge pressure of the main pumps 14. In the present embodiment, the discharge pressure sensors 28 output the detected values to the controller 30.

The operational pressure sensors 29 are configured to be capable of detecting the contents of an operation performed by the operator on the operation device 26. In the present embodiment, each of the operational pressure sensors 29 detects the operational direction and the operational amount of the operation device 26 corresponding to one of the actuators in the form of pressure (hydraulic pressure), and outputs the detected value to the controller 30. The contents of an operation on the operation device 26 may be detected using sensors other than the operational pressure sensors.

The main pumps 14 include a left main pump 14L and a right main pump 14R. Here, the left main pump 14L circulates hydraulic oil through a left center bypass pipeline 40L or a left parallel pipeline 42L to the hydraulic oil tank, and the right main pump 14R circulates hydraulic oil through a right center bypass pipeline 40R or a right parallel pipeline 42R to the hydraulic oil tank.

The left center bypass pipeline 40L is a hydraulic oil line passing through the control valves 171, 173, 175L, and 176L arranged in the control valve unit 17. The right center bypass pipeline 40R is a hydraulic oil line passing through the control valves 172, 174, 175R, and 176R arranged in the control valve unit 17.

The control valve 171 is a spool valve to supply hydraulic oil discharged by the left main pump 14L to the left hydraulic motor for traveling 2ML, and to switch the flow of hydraulic oil discharged by the left hydraulic motor for traveling 2ML so as to discharge the hydraulic oil into the hydraulic oil tank.

The control valve 172 is a spool valve to supply hydraulic oil discharged by the right main pump 14R to the right hydraulic motor for traveling 2MR, and to switch the flow of hydraulic oil discharged by the right hydraulic motor for traveling 2MR so as to discharge the hydraulic oil into the hydraulic oil tank.

The control valve 173 is a spool valve to supply hydraulic oil discharged by the left main pump 14L to the hydraulic motor for revolution 2A, and to switch the flow of hydraulic oil discharged by the hydraulic motor for revolution 2A so as to discharge the hydraulic oil into the hydraulic oil tank.

The control valve 174 is a spool valve to supply hydraulic oil discharged by the right main pump 14R to the bucket cylinder 9, and to switch the flow of hydraulic oil in the bucket cylinder 9 so as to discharge the hydraulic oil into the hydraulic oil tank.

The control valve 175L is a spool valve to switch the flow of hydraulic oil so as to supply hydraulic oil discharged by the left main pump 14L to the boom cylinder 7. The control valve 175R is a spool valve to supply hydraulic oil discharged by the right main pump 14R to the boom cylinder 7, and to switch the flow of hydraulic oil in the boom cylinder 7 so as to discharge the hydraulic oil into the hydraulic oil tank.

The control valve 176L is a spool valve to supply hydraulic oil discharged by the left main pump 14L to the arm cylinder 8, and to switch the flow of hydraulic oil in the arm cylinder 8 so as to discharge the hydraulic oil into the hydraulic oil tank.

The control valve 176R is a spool valve to supply hydraulic oil discharged by the right main pump 14R to the arm cylinder 8, and to switch the flow of hydraulic oil in the arm cylinder 8 so as to discharge the hydraulic oil into the hydraulic oil tank.

The left parallel pipeline 42L is a hydraulic oil line parallel to the left center bypass pipeline 40L. The left parallel pipeline 42L can provide hydraulic oil to a downstream control valve in the case where the flow of hydraulic oil through the left center bypass pipeline 40L is restricted or cut off by one of the control valves 171, 173, and 175L. The right parallel pipeline 42R is a hydraulic oil line parallel to the right center bypass pipeline 40R. The right parallel pipeline 42R can provide hydraulic oil to a downstream control valve in the case where the flow of hydraulic oil through the right center bypass pipeline 40R is restricted or cut off by one of the control valves 172, 174, and 175R.

The regulators 13 include a left regulator 13L and a right regulator 13R. Depending on the discharge pressure of the left main pump 14L, the left regulator 13L adjusts the tilt angle of the swashplate of the left main pump 14L, so as to control the discharge amount of the left main pump 14L. Specifically, the left regulator 13L adjusts the tilt angle of the left main pump 14L, for example, in response to an increase in the discharge pressure of the left main pump 14L, so as to reduce the discharge amount. The same applies to the right regulator 13R. This is to control the absorbed power (absorbed horsepower) of the main pumps 14, which is expressed by a product of the discharge pressure and the discharge volume, so as not to exceed the output power (output horsepower) of the engine 11.

The operation device 26 includes a left operation lever 26L, a right operation lever 26R, and a traveling lever 26D. The traveling levers 26D include a left traveling lever 26DL and a right traveling lever 26DR.

The left operation lever 26L is used for a revolution operation and an operation of the arm 5. When the left operation lever 26L is operated in the front-and-back direction, hydraulic oil discharged by the pilot pump 15 is used for introducing a control pressure according to the operational amount of the lever into the pilot port of the control valve 176. Also, when operated in the right-and-left direction, hydraulic oil discharged by the pilot pump 15 is used for introducing a control pressure according to the operational amount of the lever into the pilot port of the control valve 173.

Specifically, when operated in the arm-closing direction, the left operation lever 26L introduces hydraulic oil into the right pilot port of the control valve 176L, and introduces hydraulic oil into the left pilot port of the control valve 176R. Also, when operated in the arm-opening direction, the left operation lever 26L introduces hydraulic oil into the left pilot port of the control valve 176L, and introduces hydraulic oil into the right pilot port of the control valve 176R. Also, when operated in the left-revolution direction, the left operation lever 26L introduces hydraulic oil into the left pilot port of the control valve 173, and when operated in the right-revolution direction, introduces hydraulic oil into the right pilot port of the control valve 173.

The right operation lever 26R is used for an operation of the boom 4 and an operation of the bucket 6. When the right operation lever 26R is operated in the front-and-back direction, hydraulic oil discharged by the pilot pump 15 is used for introducing a control pressure according to the operational amount of the lever into the pilot port of the control valve 175. Also, when operated in the right-and-left direction, hydraulic oil discharged by the pilot pump 15 is used for introducing a control pressure according to the operational amount of the lever into the pilot port of the control valve 174.

Specifically, when operated in the boom-descending direction, the right operation lever 26R introduces hydraulic oil into the left pilot port of the control valve 175R. Also, when operated in the boom-raising direction, the right operation lever 26R introduces hydraulic oil into the right pilot port of the control valve 175L, and introduces hydraulic oil into the left pilot port of the control valve 175R. Also, when operated in the bucket-closing direction, the right operation lever 26R introduces hydraulic oil into the right pilot port of the control valve 174, and when operated in the bucket-opening direction, introduces hydraulic oil into the left pilot port of the control valve 174.

The traveling levers 26D are used for operations of the crawlers 1C. Specifically, the left traveling lever 26DL is used for an operation of the left crawler 1CL. It may be configured to link to the left traveling pedal. When the left traveling lever 26DL is operated in the front-and-back direction, hydraulic oil discharged by the pilot pump 15 is used for introducing a control pressure according to the operational amount of the lever into the pilot port of the control valve 171. The right traveling lever 26DR is used for an operation of the right crawler 1CR. It may be configured to link to the right traveling pedal. When the right traveling lever 26DR is operated in the front-and-back direction, hydraulic oil discharged by the pilot pump 15 is used for introducing a control pressure according to the operational amount of the lever into the pilot port of the control valve 172.

The discharge pressure sensors 28 include a discharge pressure sensor 28L and a discharge pressure sensor 28R. The discharge pressure sensor 28L detects the discharge pressure of the left main pump 14L, and outputs the detected value to the controller 30. The same applies to the discharge pressure sensor 28R.

The operational pressure sensors 29 include operational pressure sensors 29LA, 29LB, 29RA, 29RB, 29DL, and 29DR. The operational pressure sensor 29LA detects the contents of an operation in the front-and-back direction performed by the operator on the left operation lever 26L in the form of pressure, and outputs the detected value to the controller 30. The contents of an operation include, for example, the operational direction of the lever and the operational amount of the lever (the operation angle of the lever).

Similarly, the operational pressure sensor 29LB detects the contents of an operation in the right-and-left direction performed by the operator on the left operation lever 26L in the form of pressure, and outputs the detected value to the controller 30. The operational pressure sensor 29RA detects the contents of an operation in the front-and-back direction performed by the operator on the right operation lever 26R in the form of pressure, and outputs the detected value to the controller 30. The operational pressure sensor 29RB detects the contents of an operation in the right-and-left direction performed by the operator on the right operation lever 26R in the form of pressure, and outputs the detected value to the controller 30. The operational pressure sensor 29DL detects the contents of an operation in the front-and-back direction performed by the operator on the left traveling lever 26DL in the form of pressure, and outputs the detected value to the controller 30. The operational pressure sensor 29DR detects the contents of an operation in the front-and-back direction performed by the operator on the right traveling lever 26DR in the form of pressure, and outputs the detected value to the controller 30.

The controller 30 receives the output of the operational pressure sensors 29, and outputs a control command to the regulators 13 when necessary, to vary the discharge amount of the main pumps 14. Also, the controller 30 receives output of a control pressure sensor 19 provided upstream of the throttle valve 18, and outputs a control command to the regulator 13 as required, to change the discharge amount of the main pump 14. The throttles 18 include a left throttle 18L and a right throttle 18R, and the control pressure sensors 19 include a left control pressure sensor 19L and a right control pressure sensor 19R.

Along the left center bypass pipeline 40L, the left throttle 18L is arranged between the control valve 176L located most downstream, and the hydraulic oil tank. Therefore, the flow of hydraulic oil discharged by the left main pump 14L is restricted by the left throttle 18L. In addition, the left throttle 18L generates a control pressure for controlling the left regulator 13L. The left control pressure sensor 19L is a sensor for detecting this control pressure, and outputs a detected value to the controller 30. In response to this control pressure, the controller 30 adjusts the tilt angle of the swashplate of the left main pump 14L, so as to control the discharge amount of the left main pump 14L. The controller 30 reduces the discharge amount of the left main pump 14L to be smaller while the control pressure becomes greater, and increases the discharge amount of the left main pump 14L to be greater while the control pressure becomes smaller. The controller 30 also controls the discharge amount of the right main pump 14R in substantially the same way.

Specifically, as illustrated in FIG. 3, in a stand-by state where none of the hydraulic actuators in the shovel 100 is operated, hydraulic oil discharged by the left main pump 14L reaches the left throttle 18L through the left center bypass pipeline 40L. Also, the flow of hydraulic oil discharged by the left main pump 14L increases the control pressure generated upstream of the left throttle 18L. As a result, the controller 30 reduces the discharge amount of the left main pump 14L down to the minimum allowable discharge amount, to control pressure loss (pumping loss) when the discharged hydraulic oil passes through the left center bypass pipeline 40L. On the other hand, in the case where one of the hydraulic actuators is operated, the hydraulic oil discharged by the left main pump 14L flows into the hydraulic actuator through a control valve corresponding to the hydraulic actuator to be operated. Then, the flow of hydraulic oil discharged by the left main pump 14L reduces or eliminates the amount to reach the left throttle 18L, which reduces the control pressure generated upstream of the left throttle 18L. As a result, the controller 30 increases the discharge amount of the left main pump 14L, to cause a sufficient amount of hydraulic oil to circulate in the hydraulic actuator to be operated, so as to surely drive the hydraulic actuator to be operated. Note that the controller 30 also controls the discharge amount of the right main pump 14R in substantially the same way.

With the configuration as described above, the hydraulic system in FIG. 3 can reduce wasteful energy consumption in the main pumps 14 in a stand-by state. The wasteful energy consumption includes a pumping loss generated by hydraulic oil discharged by the main pumps 14 in the center bypass pipelines 40. Also, in the case of operating a hydraulic actuator, the hydraulic system in FIG. 3 can securely supply the necessary and sufficient hydraulic oil from the main pumps 14 to the hydraulic actuators to be operated.

Figure 4A:
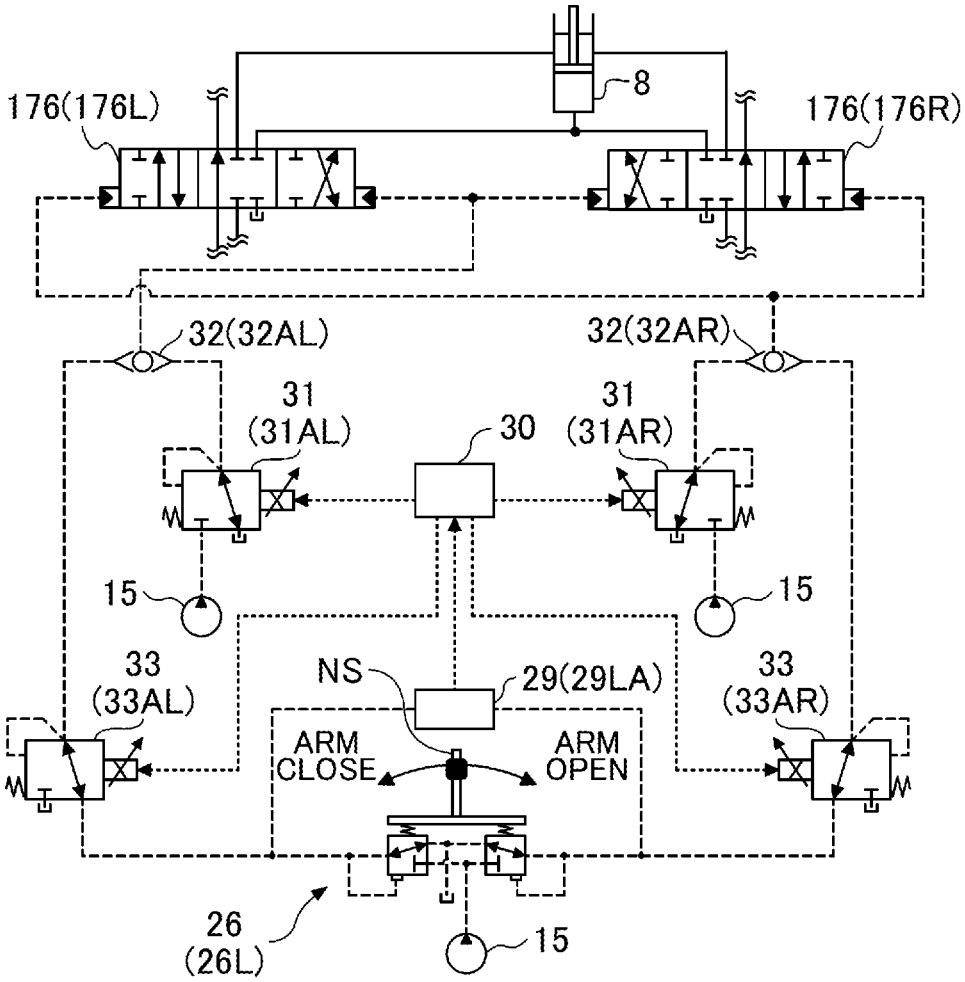
FIG. 4A is a diagram in which part of a hydraulic system related to operations of an arm cylinder is extracted.
Figure 4B:
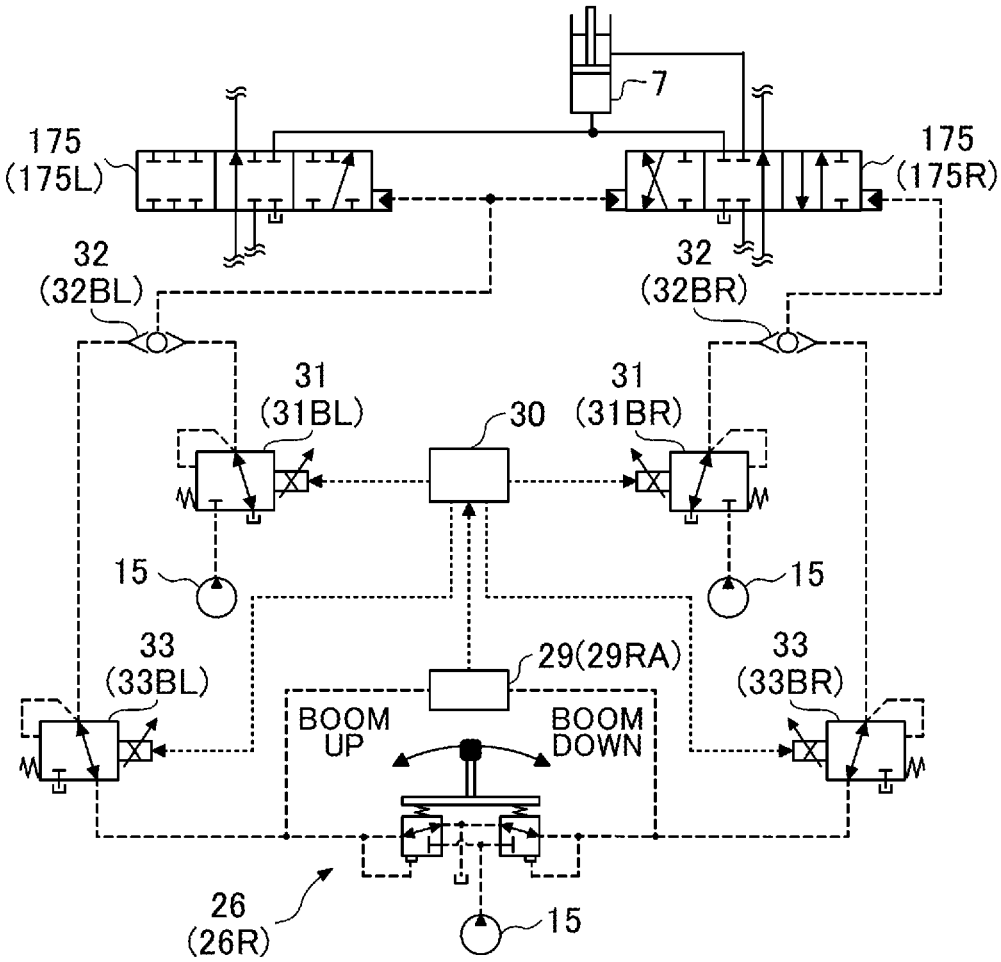
FIG. 4B is a diagram in which part of a hydraulic system related to operations of a boom cylinder is extracted.
Figure 4C:
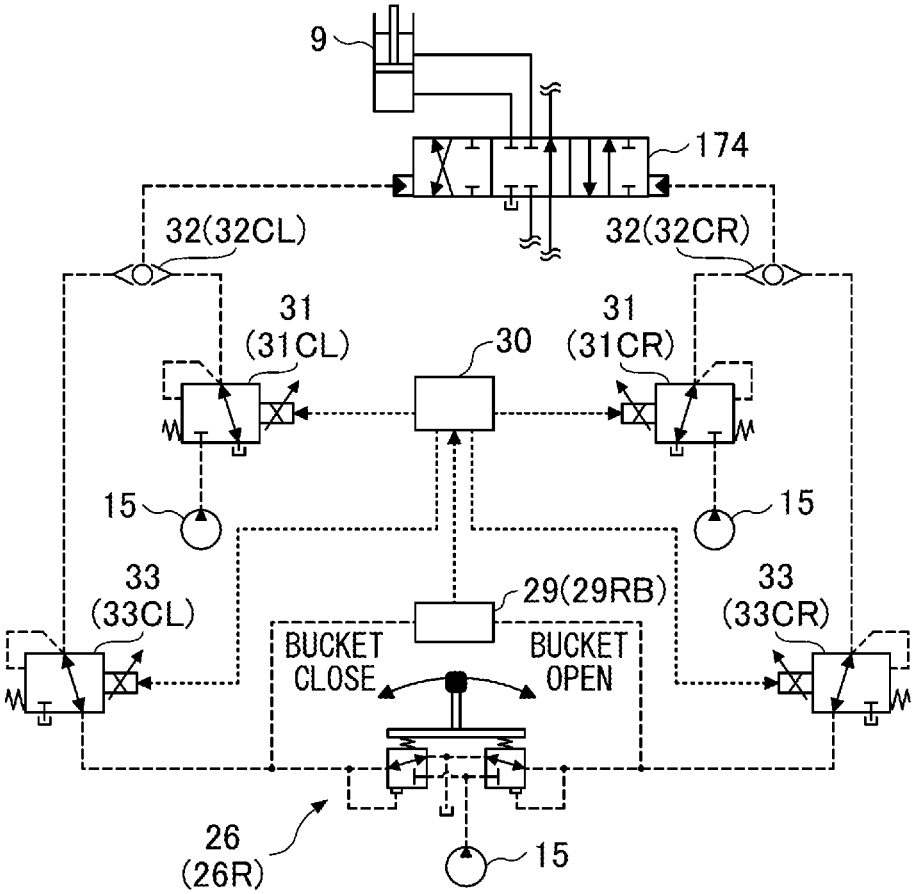
FIG. 4C is a diagram in which part of a hydraulic system related to operations of a bucket cylinder is extracted.
Figure 4D:
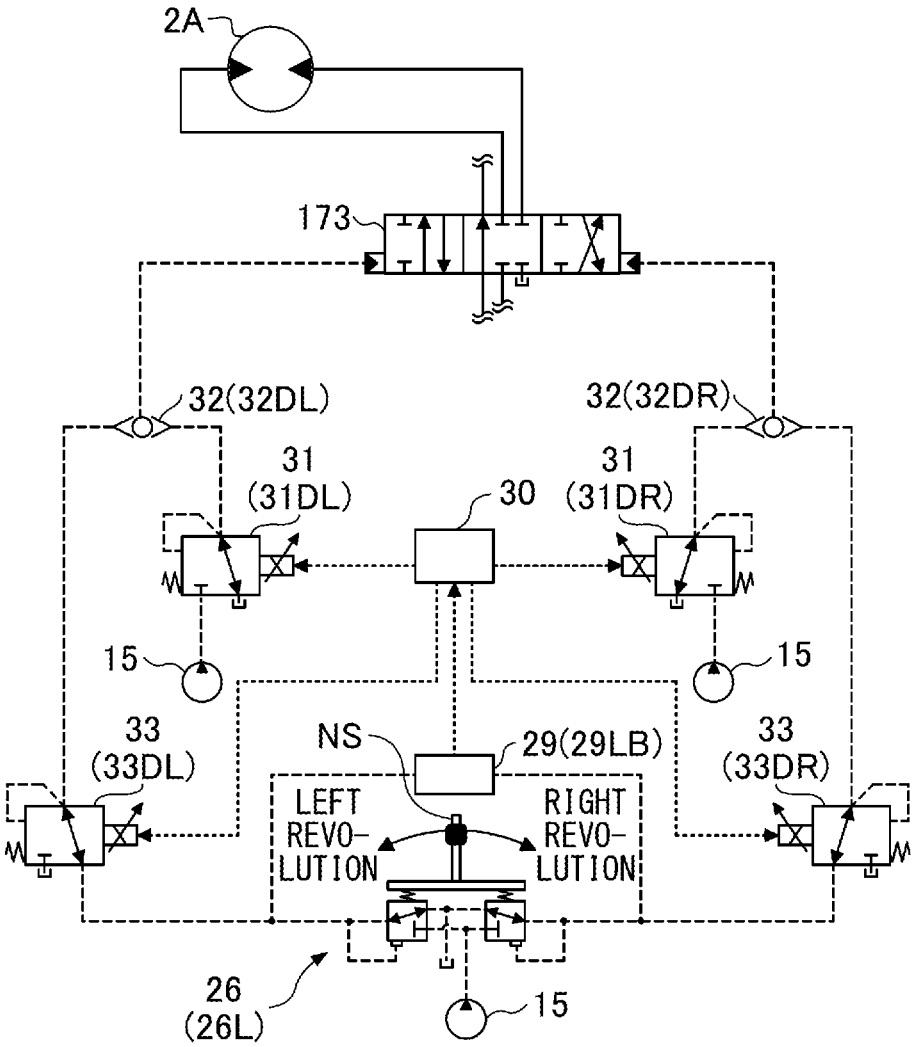
FIG. 4D is a diagram in which part of a hydraulic system related to operations of a hydraulic motor for revolution is extracted.

Next, with reference to FIG. 4A to 4D, a configuration of the controller 30 for causing the actuators to operate by the machine control functions will be described. FIGS. 4A to 4D are diagrams in each of which part of the hydraulic system is extracted. Specifically, FIG. 4A is a diagram in which part of a hydraulic system related to operations of an arm cylinder 8 is extracted; and FIG. 4B is a diagram in which part of a hydraulic system related to operations of a boom cylinder 7 is extracted; FIG. 4C is a diagram in which part of a hydraulic system related to operations of a bucket cylinder 9 is extracted; and FIG. 4D is a diagram in which part of a hydraulic system related to operations of a hydraulic motor for revolution 2A is extracted.

As illustrated in FIG. 4A to 4D, the hydraulic system includes proportional valves 31, shuttle valves 32, and proportional valves 33. The proportional valves 31 include proportional valves 31AL-31DL and 31AR-31DR; the shuttle valves 32 include shuttle valves 32AL-32DL and 32AR-32DR; and the proportional valves 33 include proportional valves 33AL-33DL and 33AR-33DR.

Each proportional valve 31 functions as a control valve for machine control. The proportional valve 31 is arranged in a pipeline connecting the pilot pump 15 and a corresponding shuttle valve 32, and is configured to capable of changing the flow area of the pipeline. In the present embodiment, the proportional valve 31 operates in response to a control command output by the controller 30. Therefore, regardless of an operation on the operation device 26 performed by the operator, the controller 30 can supply hydraulic oil discharged by the pilot pump 15 to the pilot port of a corresponding control valve in the control valve unit 17, via the proportional valves 31 and the shuttle valves 32.

Each shuttle valve 32 has two inlet ports and one outlet port. One of the two inlet ports is connected to the operation device 26, and the other is connected to a corresponding proportional valve 31. The outlet port is connected to the pilot port of a corresponding control valve in the control valve unit 17. Therefore, the shuttle valve 32 can cause higher pressure among of the pilot pressure generated by the operation device 26 and the pilot pressure generated by the proportional valve 31, to work on the pilot port of the corresponding control valve.

Like the proportional valve 31, each proportional valve 33 functions as a control valve for machine control. The proportional valve 33 is arranged in a pipeline connecting the operation device 26 and a corresponding shuttle valve 32, and is configured to be capable of changing the flow area of the pipeline. In the present embodiment, the proportional valve 33 operates in response to a control command output by the controller 30. Therefore, regardless of an operation on the operation device 26 performed by the operator, the controller 30 can supply hydraulic oil discharged by the operation device 26, after reducing the pressure of hydraulic oil, to the pilot port of a corresponding control valve in the control valve unit 17, via the shuttle valve 32.

With this configuration, even in the case where no operation is performed on a particular element of the operation device 26, the controller 30 can cause a hydraulic actuator corresponding to the particular element of the operation device 26 to operate. Also, even in the case where an operation is performed on the particular element of the operation device 26, the controller 30 can forcibly stop the operation of the hydraulic actuator corresponding to the particular element of the operation device 26.

For example, as illustrated in FIG. 4A, the left operation lever 26L is used for operating the arm 5. Specifically, by using hydraulic oil discharged by the pilot pump 15, the left operation lever 26L causes to pilot pressure according to the amount of operation in the front-and-back direction, to work on the pilot port of the control valves 176. More specifically, in the case where an operation is performed in the arm-closing direction (backward direction), the left operation lever 26L causes to pilot pressure according to the amount of operation to work on the right pilot port of the control valve 176L and the left pilot port of the control valve 176R. Also, in the case where an operation is performed in the arm-opening direction (forward direction), the left operation lever 26L causes to pilot pressure according to the amount of operation to work on the left pilot port of the control valve 176L and the right pilot port of the control valve 176R.

The left operation lever 26L is provided with a switch NS. In the present embodiment, the switch NS is a push-button switch provided at the tip of the left operation lever 26L. The operator can operate the left operation lever 26L while pressing the switch NS. The switch NS may be provided in the right operation lever 26R, or may be provided in any other position in the cabin 10.

The operational pressure sensor 29LA detects the contents of an operation in the front-and-back direction performed by the operator on the left operation lever 26L in the form of pressure, and outputs the detected value to the controller 30.

The proportional valve 31AL operates in response to a control command (a current command) output by the controller 30, to adjust the pilot pressure that is generated with hydraulic oil from the pilot pump 15, and to be introduced to the right pilot port of the control valve 176L and to the left pilot port of the control valve 176R, via the proportional valve 31AL and the shuttle valve 32AL. The proportional valve 31AR operates in response to a control command (a current command) output by the controller 30, to adjust the pilot pressure that is generated with hydraulic oil from the pilot pump 15, and to be introduced to the left pilot port of the control valve 176L and to the right pilot port of the control valve 176R, via the proportional valve 31AR and the shuttle valve 32AR. The proportional valves 31AL and 31AR can adjust the pilot pressure so as to stop the control valves 176L and 176R at any respective valve positions.

With this configuration, regardless of an arm-closing operation performed by the operator, the controller 30 can supply hydraulic oil discharged by the pilot pump 15 to the right pilot port of the control valve 176L and the left pilot port of the control valve 176R, via the proportional valve 31AL and the shuttle valve 32AL. In other words, the arm 5 can be closed. Also, regardless of an arm-opening operation performed by the operator, the controller 30 can supply hydraulic oil discharged by the pilot pump 15 to the left pilot port of the control valve 176L and the right pilot port of the control valve 176R, via the proportional valve 31AR and the shuttle valve 32AR. In other words, the arm 5 can be opened.

The proportional valve 33AL operates in response to a control command (a current command) output by the controller 30, to reduce the pilot pressure that is generated with hydraulic oil from the pilot pump 15, and to be introduced to the right pilot port of the control valve 176L and to the left pilot port of the control valve 176R, via the left operation lever 26L, the proportional valve 33AL, and the shuttle valve 32AL. The proportional valve 33AR operates in response to a control command (a current command) output by the controller 30, to reduce the pilot pressure that is generated with hydraulic oil from the pilot pump 15, and to be introduced to the left pilot port of the control valve 176L and to the right pilot port of the control valve 176R, via the left operation lever 26L, the proportional valve 33AR, and the shuttle valve 32AR. The proportional valves 33AL and 33AR can adjust the pilot pressure so as to stop the control valves 176L and 176R at any respective valve positions.

With this configuration, even in the case where an arm-closing operation is performed by the operator, if required, the controller 30 can reduce the pilot pressure working on the pilot ports on the closing side of the control valves 176 (the left pilot port of the control valve 176L and the right pilot port of the control valve 176R), to forcibly stop the closing operation of the arm 5. The same applies to the case of forcibly stopping an opening operation of the arm 5 while the arm-opening operation is being performed by the operator.

Alternatively, even in the case where an arm-opening operation is performed by the operator, if required, the controller 30 may control the proportional valve 31AR to increase the pilot pressure working on the pilot ports on the opening side of the control valves 176 (the right pilot port of the control valve 176L and the left pilot port of the control valve 176R) on the opposite side of the pilot ports with respect to the closing side of the control valves 176, so as to forcibly return the control valves 176 to the neutral position, and thereby, to forcibly stop the closing operation of the arm 5. In this case, the proportional valve 33AL may be omitted. The same applies to the case of forcibly stopping an opening operation of the arm 5 while the arm-opening operation is being performed by the operator.

Also, although the description is omitted with reference to FIGS. 4B to 4D below, the same applies to the case of forcibly stopping an operation of the boom 4 while a boom-up operation or a boom-down operation is performed by the operator; the case of forcibly stopping an operation of the bucket 6 while a bucket-closing operation or a bucket-opening operation is performed by the operator; and the case of forcibly stopping a revolution operation of the revolving upper body 3 while the revolution operation is performed by the operator. Also, the same applies to the case of forcibly stopping a traveling operation of the traveling lower body 1 while the traveling operation is being performed by the operator.

Also, as illustrated in FIG. 4B, the right operation lever 26R is used for operating the boom 4. Specifically, by using hydraulic oil discharged by the pilot pump 15, the right operation lever 26R causes to pilot pressure according to the amount of operation in the front-and-back direction, to work on the pilot port of the control valve 175. More specifically, in the case where an operation is performed in the boom-up direction (backward direction), the right operation lever 26R causes to pilot pressure according to the amount of operation to work on the right pilot port of the control valve 175L and the left pilot port of the control valve 175R. Also, in the case where an operation is performed in the boom-down direction (forward direction), the right operation lever 26R causes to pilot pressure according to the amount of operation to work on the right pilot port of the control valve 175R.

The operational pressure sensor 29RA detects the contents of an operation in the front-and-back direction performed by the operator on the right operation lever 26R in the form of pressure, and outputs the detected value to the controller 30.

The proportional valve 31BL operates in response to a control command (a current command) output by the controller 30, to adjust the pilot pressure that is generated with hydraulic oil from the pilot pump 15, and to be introduced to the right pilot port of the control valve 175L and to the left pilot port of the control valve 175R, via the proportional valve 31BL and the shuttle valve 32BL. The proportional valve 31BR operates in response to a control command (a current command) output by the controller 30, to adjust the pilot pressure that is generated with hydraulic oil from the pilot pump 15, and to be introduced to the left pilot port of the control valve 175L and to the right pilot port of the control valve 175R, via the proportional valve 31BR and the shuttle valve 32BR. The proportional valves 31BL and 31BR can adjust the pilot pressure so as to stop the control valve 175L and 175R at any respective valve positions.

With this configuration, regardless of a boom-up operation performed by the operator, the controller 30 can supply hydraulic oil discharged by the pilot pump 15 to the right pilot port of the control valve 175L and the left pilot port of the control valve 175R, via the proportional valve 31BL and the shuttle valve 32BL. In other words, the boom 4 can be raised. Also, regardless of a boom-down operation performed by the operator, the controller 30 can supply hydraulic oil discharged by the pilot pump 15 to the right pilot port of the control valve 175R, via the proportional valve 31BR and the shuttle valve 32BR. In other words, the boom 4 can be lowered.

Also, as illustrated in FIG. 4C, the right operation lever 26R is also used for operating the bucket 6. Specifically, by using hydraulic oil discharged by the pilot pump 15, the right operation lever 26R causes to pilot pressure according to the amount of operation in the left-and-right direction, to work on the pilot port of the control valve 174. More specifically, in the case where an operation is performed in the bucket-closing direction (left direction), the right operation lever 26R causes to pilot pressure according to the amount of operation to work on the left pilot port of the control valve 174. Also, in the case where an operation is performed in the bucket-opening direction (right direction), the right operation lever 26R causes to pilot pressure according to the amount of operation to work on the right pilot port of the control valve 174.

The operational pressure sensor 29RB detects the contents of an operation in the right-and-left direction performed by the operator on the right operation lever 26R in the form of pressure, and outputs the detected value to the controller 30.

The proportional valve 31CL operates in response to a control command (a current command) output by the controller 30, to adjust the pilot pressure that is generated with hydraulic oil from the pilot pump 15, and to be introduced to the left pilot port of the control valve 174, via the proportional valve 31CL and the shuttle valve 32CL. The proportional valve 31CR operates in response to a control command (a current command) output by the controller 30, to adjust the pilot pressure that is generated with hydraulic oil from the pilot pump 15, and to be introduced to the right pilot port of the control valve 174, via the proportional valve 31CR and the shuttle valve 32CR. The proportional valves 31CL and 31CR can adjust the pilot pressure so as to stop the control valve 174 at any respective valve positions.

With this configuration, regardless of a bucket-closing operation performed by the operator, the controller 30 can supply hydraulic oil discharged by the pilot pump 15 to the left pilot port of the control valve 174, via the proportional valve 31CL and the shuttle valve 32CL. In other words, the bucket 6 can be closed. Also, regardless of a bucket-opening operation performed by the operator, the controller 30 can supply hydraulic oil discharged by the pilot pump 15 to the right pilot port of the control valve 174, via the proportional valve 31CR and the shuttle valve 32CR. In other words, the bucket 6 can be opened.

Also, as illustrated in FIG. 4D, the left operation lever 26L is also used for operating the revolution mechanism 2. Specifically, by using hydraulic oil discharged by the pilot pump 15, the left operation lever 26L causes to pilot pressure according to the amount of operation in the left-and-right direction, to work on the pilot port of the control valve 173. More specifically, in the case where an operation is performed in the left revolution direction (left direction), the left operation lever 26L causes to pilot pressure according to the amount of operation to work on the left pilot port of the control valve 173. Also, in the case where an operation is performed in the right revolution direction (right direction), the left operation lever 26L causes to pilot pressure according to the amount of operation to work on the right pilot port of the control valve 173.

The operation pressure sensor 29LB detects, in the form of pressure, the contents of an operation performed by the operator on the left operation lever 26L in the left-and-right direction, and outputs the detected value to the controller 30.

The proportional valve 31DL operates in response to a control command (a current command) output by the controller 30, to adjust the pilot pressure that is generated with hydraulic oil from the pilot pump 15, and to be introduced to the left pilot port of the control valve 173, via the proportional valve 31DL and the shuttle valve 32DL. The proportional valve 31DR operates in response to a control command (a current command) output by the controller 30, to adjust the pilot pressure that is generated with hydraulic oil from the pilot pump 15, and to be introduced to the right pilot port of the control valve 173, via the proportional valve 31DR and the shuttle valve 32DR. The proportional valves 31DL and 31DR can adjust the pilot pressure so as to stop the control valve 173 at any respective valve positions.

With this configuration, regardless of a left revolution operation performed by the operator, the controller 30 can supply hydraulic oil discharged by the pilot pump 15 to the left pilot port of the control valve 173, via the proportional valve 31DL and the shuttle valve 32DL. In other words, it is possible to cause the revolution mechanism 2 to make a left revolution. Also, regardless of an right revolution operation performed by the operator, the controller 30 can supply hydraulic oil discharged by the pilot pump 15 to the right pilot port of the control valve 173, via the proportional valve 31DR and the shuttle valve 32DR. In other words, it is possible to cause the revolution mechanism 2 to make a right revolution.

The shovel 100 may be provided with an element that causes the traveling lower body 1 to travel forward or backward automatically or autonomously. In this case, part of the hydraulic system related to operations of the left traveling hydraulic motor 2ML, and part of the hydraulic system related to operations of the right traveling hydraulic motor 2MR, may be configured in substantially the same way as the part of the hydraulic system related to the operation of the boom cylinder 7 or the like.

Also, as a form of the operation device 26, although a hydraulic operation lever provided with a hydraulic pilot circuit has been described, an electrical operation lever provided with an electrical pilot circuit may be adopted in place of the hydraulic operation lever. In this case, the amount of the lever operation of the electric operation lever is input into the controller 30 as an electrical signal. Also, a solenoid valve is arranged between the pilot pump 15 and the pilot port of each of the control valves. The solenoid valve is configured to operate in response to an electrical signal from the controller 30. With this configuration, once a manual operation is performed using the electric operation lever, by controlling the electromagnetic valve to increase or decrease the pilot pressure, the controller 30 can move each control valve by an electrical signal corresponding to the amount of the lever operation. Note that each control valve may be constituted with a solenoid spool valve. In this case, the solenoid spool valve operates in response to an electrical signal from the controller 30 corresponding to the amount of a lever operation on the electrical operation lever.

Figure 5:
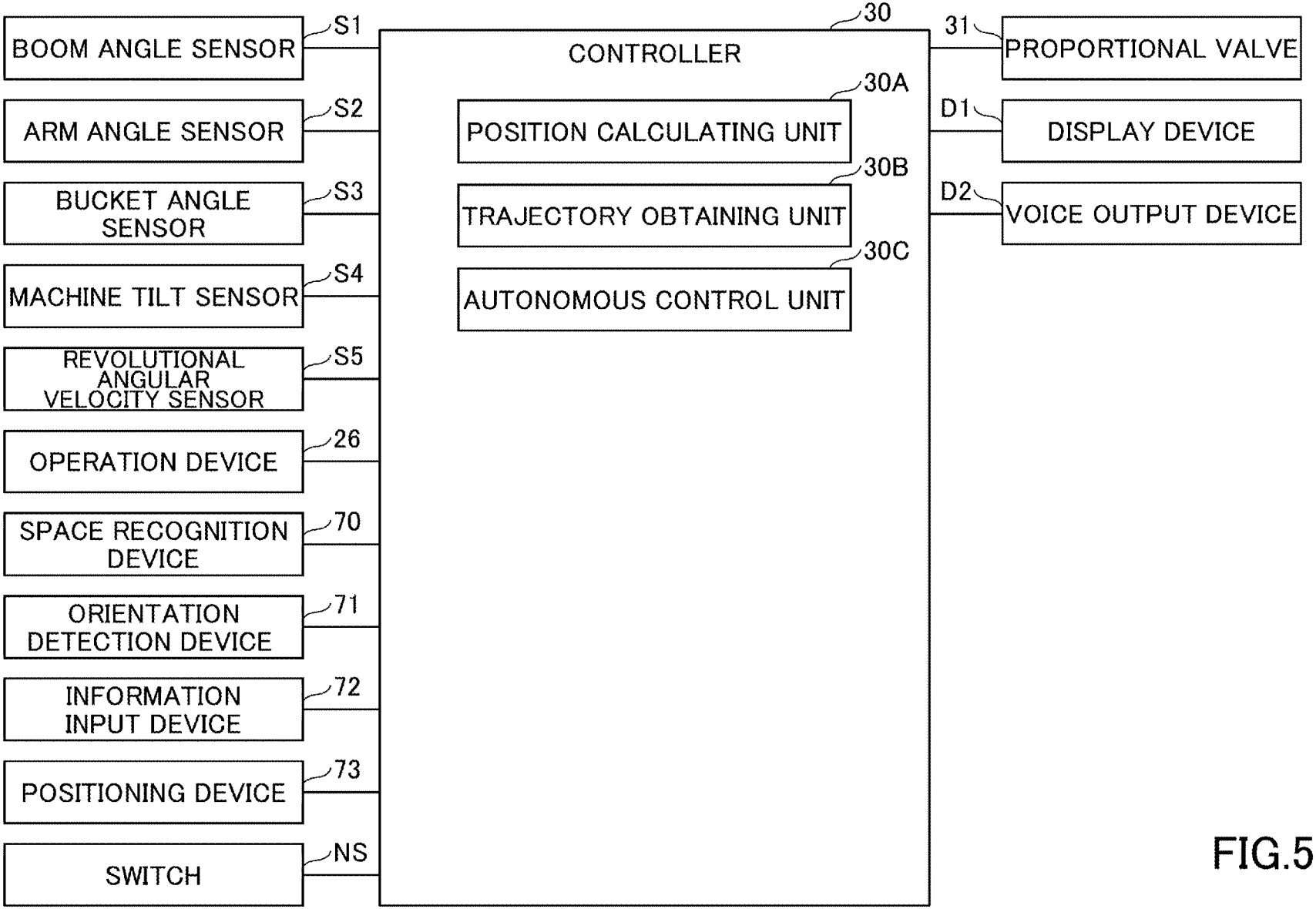
FIG. 5 is a diagram illustrating an example of a configuration of a controller.

Next, with reference to FIG. 5, an example of a configuration of the controller 30 will be described. FIG. 5 is a diagram illustrating an example of a configuration of the controller 30. In FIG. 5, the controller 30 is configured to be capable of executing various arithmetic/logical operations, to output control commands to at least one of the proportional valves 31, the display device D1, the sound output device D2, and the like, in response to receiving a signal output by at least one of the position detection device, the operation device 26, the space recognition device 70, the orientation detection device 71, the information input device 72, the positioning device 73, the switch NS, and the like. The position detection device includes the boom angle sensor S1, the arm angle sensor S2, the bucket angle sensor S3, the machine tilt sensor S4, and the revolutional angular velocity sensor S5. The controller 30 includes a position calculating unit 30A, a trajectory obtaining unit 30B, and the autonomous control unit 30C as the functional elements. Note that although the position calculating unit 30A, the trajectory obtaining unit 30B, and the autonomous control unit 30C are illustrated distinctively for the sake of convenience of the description, these do not need to be physically distinctive, and may be constituted entirely or partially with common software components or hardware components. Also, the one or more functional elements in the controller 30 may be functional elements in the other control devices such as a management device 300 that will be described later. In other words, each of the functional elements may be implemented by any of the control devices. For example, the autonomous control unit 30C may be implemented by the management device 300 external to the shovel 100.

The position calculating unit 30A is configured to calculate the position of an object as the target of positioning. In the present embodiment, the position calculating unit 30A calculates the coordinate point in the reference coordinate system of a predetermined part of the attachment. The predetermined part is, for example, the teeth end of the bucket 6. The origin of the reference coordinate system is, for example, the intersection of the revolution axis and the ground plane of the shovel 100. The reference coordinate system is, for example, an XYZ orthogonal coordinate system that includes the X-axis parallel to the front-and-back axis of the shovel 100; the Y-axis parallel to the left-and-right axis of the shovel 100; and the Z-axis parallel to the revolution axis of the shovel 100. The position calculating unit 30A calculates the coordinate point of the teeth end of the bucket 6, for example, from the respective rotation angles of the boom 4, the arm 5, and the bucket 6. The position calculating unit 30A may calculate not only the coordinate point of the center of the teeth end of the bucket 6, but also the coordinate point of the left end of the teeth end of the bucket 6, and the coordinate point of the right end of the teeth end of the bucket 6. In this case, the position calculating unit 30A may use the output of the machine tilt sensor S4. Also, by using the output of the positioning device 73, the position calculating unit 30A may calculate the coordinate point in the world coordinate system of a predetermined part of the attachment.

When the shovel 100 operates autonomously, the trajectory obtaining unit 30B is configured to obtain a target trajectory as the trajectory traced by a predetermined part of the attachment. In the present embodiment, the trajectory obtaining unit 30B obtains the target trajectory used by the autonomous control unit 30C when the shovel 100 operates autonomously. Specifically, the trajectory obtaining unit 30B derives the target trajectory based on target surface data stored in the non-volatile storage device (referred to as "design data", hereafter). The trajectory obtaining unit 30B may derive the target trajectory, based on information on the landform in the surroundings of the shovel 100 recognized by the space recognition device 70. Alternatively, the trajectory obtaining unit 30B may derive information on trajectories of the teeth end of the bucket 6 in the past from the output of the position detection device in the past stored in the volatile storage device, and based on the information, derive the target trajectory. Alternatively, the trajectory obtaining unit 30B may derive the target trajectory, based on the current position of the predetermined part of the attachment and the design data.

The autonomous control unit 30C is configured to be capable of causing the shovel 100 to operate autonomously. In the present embodiment, it is configured to move the predetermined part of the attachment along the target trajectory obtained by the trajectory obtaining unit 30B, in the case where predetermined start conditions are satisfied. Specifically, in a state of the switch NS being pressed, when the operation device 26 is operated, the autonomous control unit 30C causes the shovel 100 to operate autonomously so as to move the predetermined part along the target trajectory.

In the present embodiment, the autonomous control unit 30C is configured to cause each actuator to operate autonomously, and thereby, assist a manual operation of the shovel by the operator. For example, in the case where the operator is manually performing an arm-closing operation while pressing the switch NS, the autonomous control unit 30C may cause at least one of the boom cylinder 7, the arm cylinder 8, and the bucket cylinder 9 to expand or contract autonomously, so as to make the target trajectory coincident with the teeth end position of the bucket 6. In this case, the operator can close the arm 5, for example, simply by operating the left operation lever 26L in the arm closing direction, while having the teeth end of the bucket 6 coincident with the target trajectory. In this example, the arm cylinder 8 as the main operation target, will be referred to as the "main actuator". Also, the boom cylinder 7 and the bucket cylinder 9 as the secondary operation targets that move subordinate to the motion of the main actuator, will be referred to as the "subordinate actuators".

In the present embodiment, by supplying control commands (current command) to the proportional valves 31 to adjust pilot pressure working on the control valves corresponding to the respective actuators individually, the autonomous control unit 30C can cause each actuator to operate autonomously. For example, it is possible to cause at least one of the boom cylinder 7 and the bucket cylinder 9 to operate regardless of whether the right operation lever 26R is tilted or not.

Figure 6:
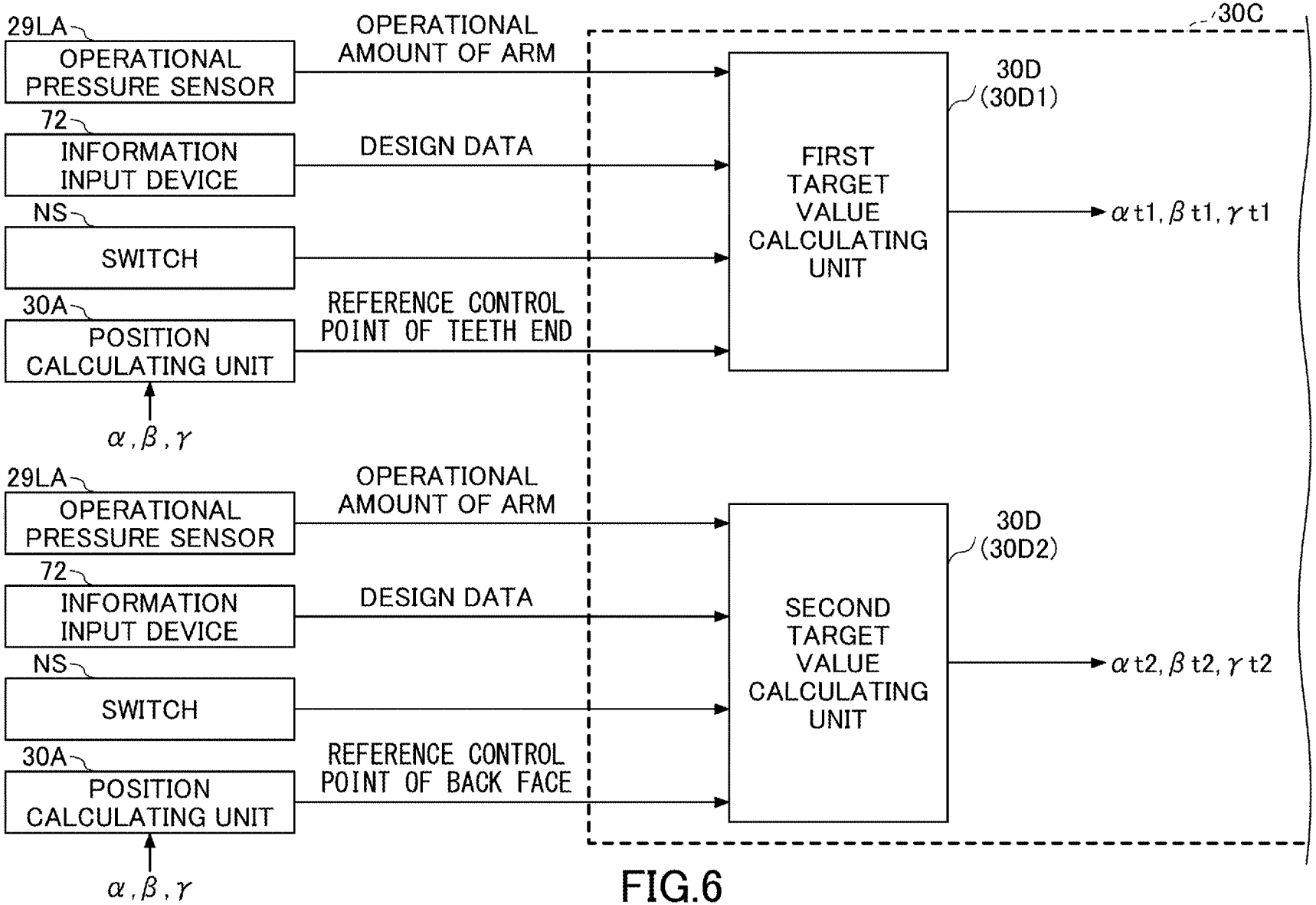
FIG. 6 is a diagram illustrating an example of a configuration of the input side of an autonomous control unit.
Figure 7:
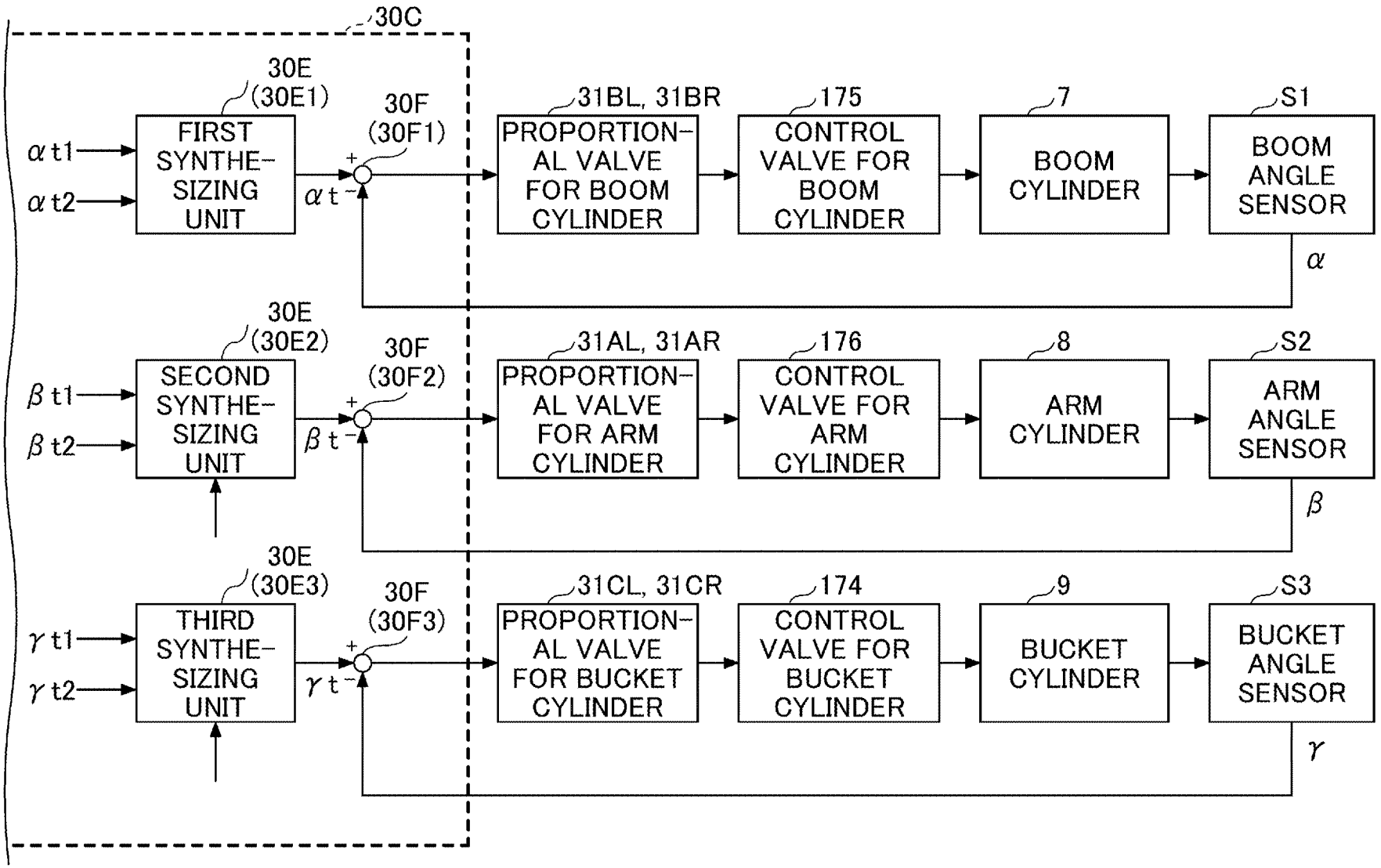
FIG. 7 is a diagram illustrating an example of a configuration of the output side of an autonomous control unit.

Next, with reference to FIGS. 6 and 7, an example of a configuration of the autonomous control unit 30C will be described. FIG. 6 is a diagram illustrating an example of a configuration of the input side of an autonomous control unit 30C. FIG. 7 is a diagram illustrating an example of a configuration of the output side of an autonomous control unit 30C.

In the present embodiment, in slope face finishing work, leveling work, or the like, the autonomous control unit 30C is configured to calculate a control value for each actuator for each of multiple predetermined points on the end attachment. The multiple predetermined points on the end attachment include, for example, points on the teeth end of the bucket 6, points on the back face of the bucket 6, and the like. The current position of each predetermined point is represented by, for example, a coordinate point in the reference coordinate system. The control values of the actuators include, for example, the control value of the boom cylinder 7, the control value of the arm cylinder 8, the control value of the bucket cylinder 9, and the like. The control value of the boom cylinder 7 is represented by, for example, the stroke amount of the boom cylinder 7, the boom angle $\alpha$, or the like. The same applies to the control value of the arm cylinder 8 and the control value of the bucket cylinder 9.

The autonomous control unit 30C can rotate the boom 4 by X degrees, for example, by outputting a command related to the boom angle "X degrees" as the control value of the boom cylinder 7, to the proportional valves 31.

For example, the autonomous control unit 30C first calculates the control value of the arm cylinder 8 as the main actuator, and then, calculate the control value of each of the boom cylinder 7 and the bucket cylinder 9 as the subordinate actuators. The control value of the arm cylinder 8 as the main actuator is adjusted (corrected) as necessary, for example, after calculated based on the operation amount of the left operation lever 26L. In addition, when the control value of the arm cylinder 8 changes, depending on the change, the control value of each of the boom cylinder 7 and the bucket cylinder 9 also changes.

In the present embodiment, the autonomous control unit 30C includes a target value calculating unit 30D, a synthesizing unit 30E, and an arithmetic/logic unit 30F. The target value calculating unit 30D is configured to calculate a target value for each actuator for each of the multiple predetermined points on the end attachment, for each predetermined control cycle. The target value is, for example, a value related to the position (target position) of a predetermined point in the end attachment after a predetermined time, and typically, represented by the target boom angle, the target arm angle, and the target bucket angle. Note that although the target value calculating unit 30D, the synthesizing unit 30E, and the arithmetic/logic unit 30F are illustrated distinctively for the sake of convenience of the description, these do not need to be physically distinctive, and may be constituted entirely or partially with common software components or hardware components. Also, the one or more functional elements in the autonomous control unit 30C may be functional elements in the other control devices such as the management device 300 that will be described later. In other words, each of the functional elements may be implemented by any of the control devices. For example, the target value calculating unit 30D and the synthesizing unit 30E may be implemented by the management device 300 external to the shovel 100.

In the present embodiment, the target value calculating unit 30D includes a first target value calculating unit 30D1 and a second target value calculating unit 30D2. The first target value calculating unit 30D1 is configured to calculate a target value related to a reference control point Pa at the teeth end of the bucket 6 (see FIG. 1). The second target value calculating unit 30D2 is configured to calculate a target value related to a reference control point Pb on the back face of the bucket 6 (see FIG. 1).

Specifically, the first target value calculating unit 30D1 calculates a target position related to the reference control point Pa at the teeth end of the bucket 6, based on the output of each of the operation pressure sensor 29LA, the information input device 72, the switch NS, and the position calculating unit 30A. The target position is a position at which the control reference point Pa reaches after the predetermined time.

More specifically, based on the output of the operation pressure sensor 29LA and the output of the switch NS, in a state of the switch NS being pressed, the first target value calculating unit 30D1 determines whether or not the left operation lever 26L is being operated in the front-and-back direction. In addition, in a state of the switch NS being pressed, in the case where it is determined that the left operation lever 26L is being operated in the front-and-back direction, based on the current position of the control reference point Pa and the information on the target surface, the first target value calculating unit 30D1 calculates the target position of the control reference point Pa. The information on the target surface is derived, for example, from the design data input through the information input device 72. The information on a target surface includes, for example, a slope face angle and the like. The current position of the control reference point Pa is calculated by, for example, the position calculating unit 30A. The position calculating unit 30A calculates the current position of the control reference point Pa based on, for example, the outputs of the boom angle sensor S1, the arm angle sensor S2, the bucket angle sensor S3, and the like. In addition, based on the calculated target position of the control reference point Pa, the first target value calculating unit 30D1 derives a boom angle $\alpha$t1, an arm angle $\beta$t1, and a bucket angle $\gamma$t1, when the control reference point Pa is moved to the target position. In the present embodiment, the boom angle $\alpha$t1 represents a first control value related to the boom cylinder 7. Similarly, the arm angle $\beta$t1 represents a first control value related to the arm cylinder 8, and the bucket angle $\gamma$t1 represents a first control value related to the bucket cylinder 9.

Like the first target value calculating unit 30D1, the second target value calculating unit 30D2 calculates a target position related to the reference control point Pb on the back face of the bucket 6, based on the output of each of the operation pressure sensor 29LA, the information input device 72, the switch NS, and the position calculating unit 30A. The target position is a position at which the control reference point Pb reaches after the predetermined time.

Specifically, like the first target value calculating unit 30D1, in a state of the switch NS being pressed, the second target value calculating unit 30D2 determines whether or not the left operation lever 26L is being operated in the front-and-back direction. In addition, in a state of the switch NS being pressed, in the case where it is determined that the left operation lever 26L is being operated in the front-and-back direction, based on the current position of the control reference point Pb and the information on the target surface, the second target value calculating unit 30D2 calculates the target position of the control reference point Pb. In addition, based on the calculated target position of the control reference point Pb, the second target value calculating unit 30D2 derives a boom angle $\alpha$t2, an arm angle $\beta$t2, and a bucket angle $\gamma$t2, when the control reference point Pb is moved to the target position. In the present embodiment, the boom angle $\alpha$t2 represents a second control value related to the boom cylinder 7. Similarly, the arm angle $\beta$t2 represents a second control value related to the arm cylinder 8, and the bucket angle $\gamma$t2 represents a second control value related to the bucket cylinder 9.

In the present embodiment, although the first target value calculating unit 30D1 and the second target value calculating unit 30D2 are separate functional elements that operate independently from one another, these elements may be integrally configured as the same functional element.

The synthesizing unit 30E is configured to synthesize multiple control values for each actuator. In the present embodiment, the synthesizing unit 30E includes a first synthesizing unit 30E1, a second synthesizing unit 30E2, and a third synthesizing unit 30E3.

The arithmetic/logic unit 30F is configured to generate control commands (current commands) to be output to the proportional valves 31, based on a synthesized control value output by the synthesizing unit 30E. In the present embodiment, the arithmetic/logic unit 30F includes a first arithmetic/logic unit 30F1, a second arithmetic/logic unit 30F2, and a third arithmetic/logic unit 30F3.

The first synthesizing unit 30E1 is configured to output the synthesized control value at derived by synthesizing multiple control values related to the boom cylinder 7, to the first arithmetic/logic unit 30F1. In addition, based on the synthesized control value at output by the first synthesizing unit 30E1, the first arithmetic/logic unit 30F1 is configured to generate control commands (current commands) related to the boom cylinder 7, to be output to the proportional valves 31BL and 31BR. In the present embodiment, the first synthesizing unit 30E1 derives the synthesized control value at, by synthesizing the first control value (boom angle $\alpha$t1) and the second control value (boom angle $\alpha$t2) related to the boom cylinder 7. "Synthesis" can be one of an arithmetic mean, a geometrical mean, a weighted mean, a selection from among several, and the like. In the case of the selection from among several, the first synthesizing unit 30E1 may compare the first control value with the second control value, to select, for example, the greater value. The first arithmetic/logic unit 30F1 generates control commands, for example, so as to make the difference between the synthesized control value at and the current boom angle $\alpha$ approach zero, and outputs the control commands to the proportional valves 31BL and 31BR related to the boom cylinder 7.

The second synthesizing unit 30E2 is configured to output the synthesized control value $\beta$t derived by synthesizing multiple control values related to the arm cylinder 8, to the second arithmetic/logic unit 30F2. In addition, based on the synthesized control value St output by the second synthesizing unit 30E2, the second arithmetic/logic unit 30F2 is configured to generate control commands (current commands) related to the arm cylinder 8, to be output to the proportional valves 31AL and 31AR. In the present embodiment, the second synthesizing unit 30E2 derives the synthesized control value $\beta$t, by synthesizing the first control value (arm angle 1) and the second control value (arm angle 2) related to the arm cylinder 8. "Synthesis" can be one of an arithmetic mean, a geometrical mean, a weighted mean, a selection from among several, and the like. In the case of the selection from among several, the second synthesizing unit 30E2 may compare the first control value with the second control value, to select, for example, the greater value. The second arithmetic/logic unit 30F2 generates control commands, for example, so as to make the difference between the synthesized control value $\beta$t and the current arm angle $\beta$ approach zero, and outputs the control commands to the proportional valves 31BL and 31BR related to the arm cylinder 8.

The third synthesizing unit 30E3 is configured to output the synthesized control value $\gamma$t derived by synthesizing multiple control values related to the bucket cylinder 9, to the third arithmetic/logic unit 30F3. In addition, based on the synthesized control value $\gamma$t output by the third synthesizing unit 30E3, the third arithmetic/logic unit 30F3 is configured to generate control commands (current commands) related to the bucket cylinder 9, to be output to the proportional valves 31CL and 31CR. In the present embodiment, the third synthesizing unit 30E3 derives the synthesized control value γt, by synthesizing the first control value (bucket angle γt1) and the second control value (bucket angle γt2) related to the bucket cylinder 9. "Synthesis" can be one of an arithmetic mean, a geometrical mean, a weighted mean, a selection from among several, and the like. In the case of the selection from among several, the third synthesizing unit 30E3 may compare the first control value with the second control value, to select, for example, the greater value. The third arithmetic/logic unit 30F3 generates control commands, for example, so as to make the difference between the synthesized control value γt and the current bucket angle γ approach zero, and outputs the control commands to the proportional valves 31CL and 31CR related to the bucket cylinder 9.

In the present embodiment, although the first synthesizing unit 30E1, the second synthesizing unit 30E2, and the third synthesizing unit 30E3 are separate functional elements that operate independently from one another, these elements may be integrally configured as the same functional element. Also in this case, "synthesis" can be one of an arithmetic mean, a geometrical mean, a weighted mean, a selection from among several, and the like. In the case of the selection from among several, the integrally configured functional element may compare the first control value with the second control value, to select, for example, the greater value. In this way, the autonomous control unit 30C controls the hydraulic actuators based on predetermined conditions, to drive the boom 4 to raise the entirety of the bucket 6, to rotate the bucket 6 so as to elevate the teeth end of the bucket 6, and the like. Also, although the first arithmetic/logic unit 30F1, the second arithmetic/logic unit 30F2, and the third arithmetic/logic unit 30F3 are separate functional elements that operate independently from one another, these elements may be integrally configured as the same functional element.

The proportional valves 31BL and 31BR cause pilot pressure according to the control command to work on the control valve 175 related to the boom cylinder 7. In response to receiving the pilot pressure generated by the proportional valves 31BL and 31BR, the control valve 175 supplies hydraulic oil discharged by the main pump 14 to the boom cylinder 7, in a flow direction and with a flow rate corresponding to the pilot pressure.

At this time, the autonomous control unit 30C may generate spool control commands based on the spool displacement of the control valve 175, as a value detected by a spool displacement sensor (not illustrated), and in addition, may output control currents corresponding to the spool control commands to the proportional valves 31BL and 31BR, respectively, in order to control the control valve 175 more highly precisely.

The boom cylinder 7 is extended or contracted by hydraulic oil supplied through the control valve 175. The boom angle sensor S1 detects the boom angle α of the boom 4 that is driven by the boom cylinder 7 being extended or contracted. In addition, the boom angle sensor S1 feeds the detected boom angle α back to the first arithmetic/logic unit 30F1 as the current value of the boom angle α.

Note that although the above description relates to the control of the boom 4 based on the synthesized control value at, these are also applicable similarly to the control of the arm 5 based on the synthesized control value βt, and to the control of the bucket 6 based on the synthesized control value γt. Therefore, as for the flow of the control of the arm 5 based on the synthesized control value βt, and the flow of the control of the bucket 6 based on the synthesized control value γt, the description is omitted.

Also, although the above description relates to the control of the boom 4, the arm 5, and the bucket 6, the same can be applied to the revolution control. In this case, the synthesizing unit 30E may be configured to synthesize multiple control values related to the revolution actuator, to derive the synthesized control values. Also, the above description also can be applied to the control of a tilt bucket in the case where a tilt bucket is attached to the tip of the arm 5 in place of the bucket 6. In this case, the synthesizing unit 30E may be configured to synthesize multiple control values related to a tilt driver (tilt cylinder), to derive the synthesized control values.

Figure 8A:
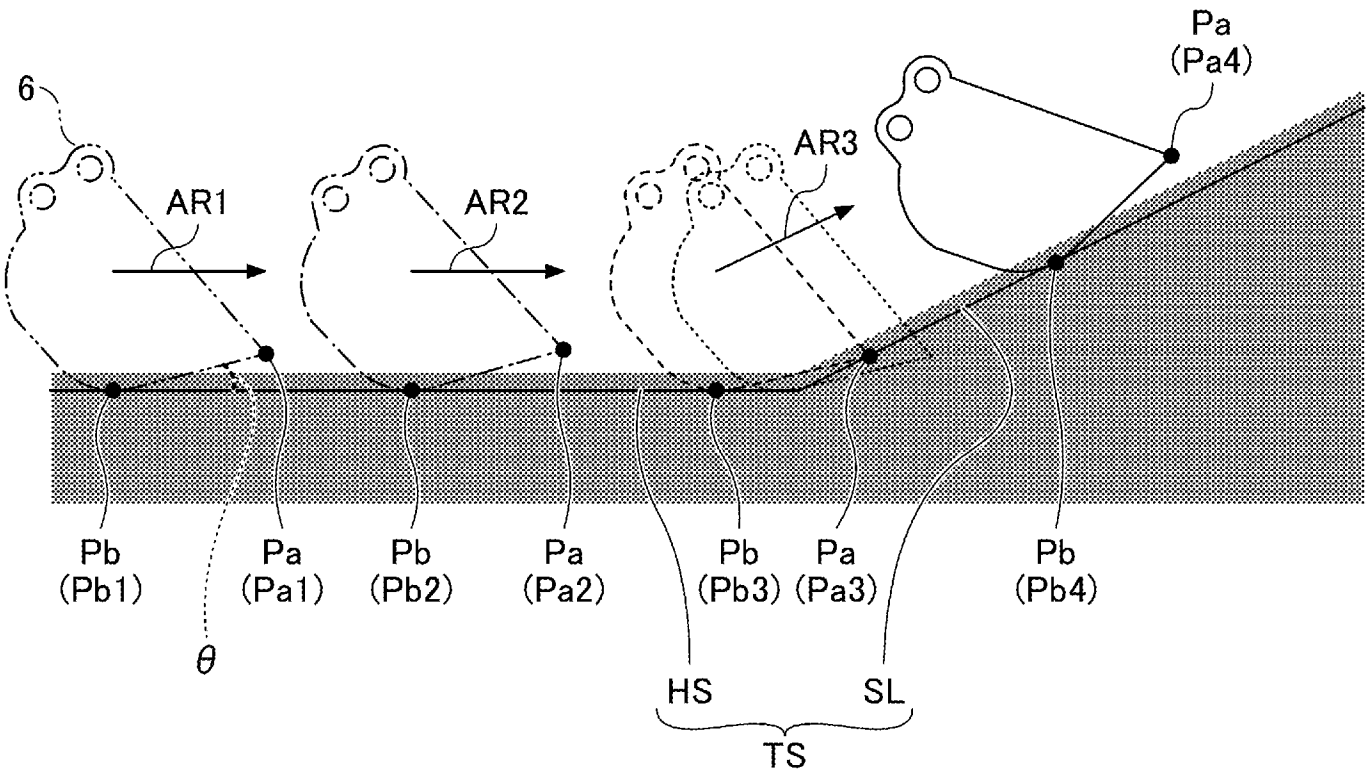
FIG. 8A is a side view of a bucket moving along a target surface.
Figure 8B:
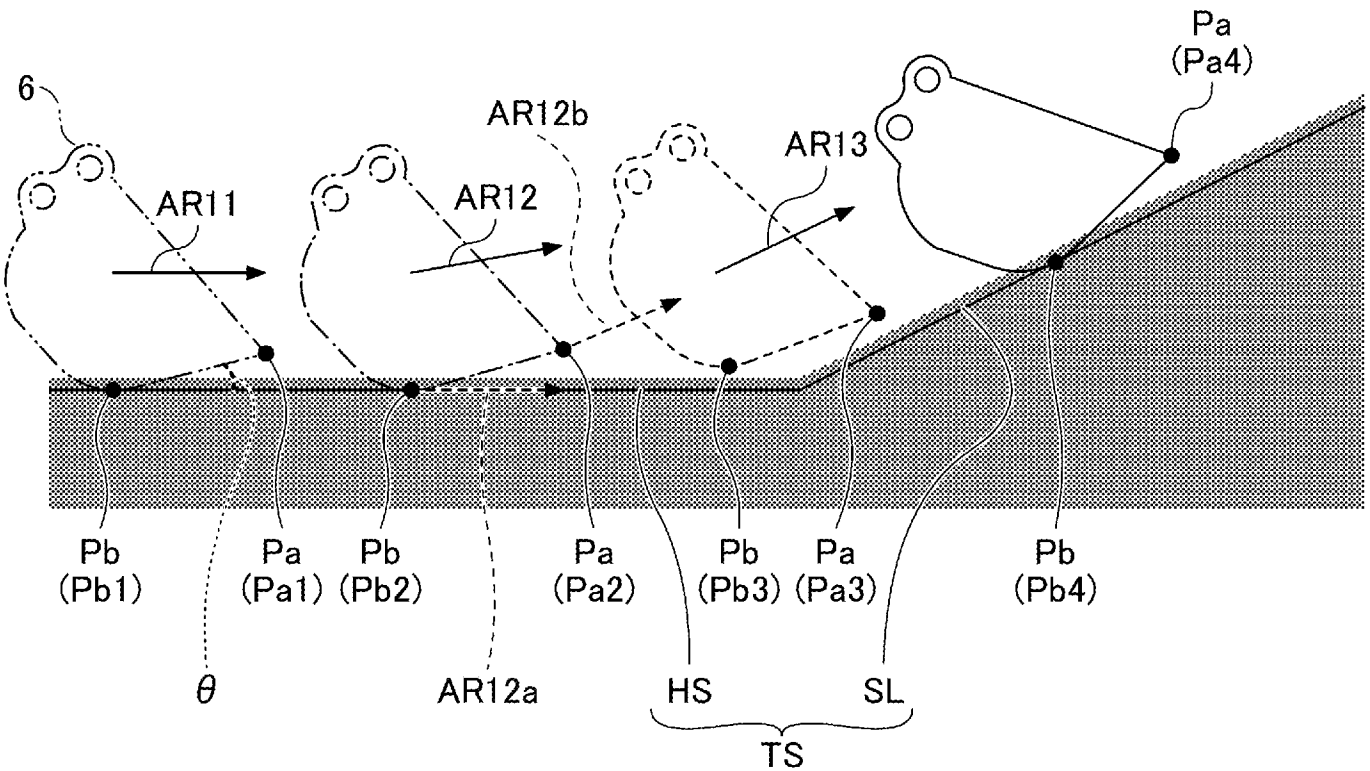
FIG. 8B is a side view of a bucket moving along a target surface.

Next, with reference to FIGS. 8A and 8B, effects of causing the actuators to operate autonomously based on the multiple control reference points will be described. FIGS. 8A and 8B are side views of the bucket 6 moving along a target surface TS. In the example in FIGS. 8A and 8B, the target surface TS includes a horizontal part HS and a tilt part SL. In a state of the switch NS being pressed, when the left operation lever 26L is operated in the arm closing direction, the autonomous control unit 30C causes the shovel 100 to operate autonomously so as to move the bucket 6 along the target surface TS, while maintaining the excavation angle θ of the bucket 6 with respect to the target surface TS.

In the example in FIGS. 8A and 8B, the autonomous control unit 30C moves the bucket 6 from left to right along the target surface TS during a period of time including a first point of time to a fourth point of time. In the example in FIGS. 8A and 8B, the bucket 6 at the first point of time is designated by a two-dot chain line; the bucket 6 at the second point of time is designated by a one-dot chain line; the bucket 6 at the third point of time is designated by a broken line; and the bucket 6 at the fourth point of time (current time) is designated by a solid line.

FIG. 8A illustrates a movement path of the bucket 6 when causing the excavation attachment AT to operate autonomously according to the control value derived by the autonomous control unit 30C based on a single control reference point. In other words, in the example in FIG. 8A, the autonomous control unit 30C causes the excavation attachment AT to operate autonomously at each point of time, according to the control value derived based on the control reference point Pa or the control reference point Pb as the closest control reference point to the target surface TS. Note that the autonomous control unit 30C derives a control value based on the current position of a control reference point closest to the target surface TS and information on the target surface.

Specifically, at the first point of time, the autonomous control unit 30C calculates a control value based on the control reference point Pb1 in contact with the horizontal part HS. In addition, the autonomous control unit 30C calculates a control value so as to move so to move the bucket 6 along the horizontal part HS, namely, the bucket 6 in the horizontal direction designated by an arrow AR1.

At the second point of time, as in the case of the first point of time, the autonomous control unit 30C calculates a control value based on the control reference point Pb2 in contact with the horizontal part HS. In addition, the autonomous control unit 30C calculates a control value so to move the bucket 6 along the horizontal part HS, namely, so as to move the bucket 6 in the horizontal direction designated by an arrow AR2.

At the third point of time, the autonomous control unit 30C calculates a control value based on the control reference point Pa3 in contact with the tilt part SL. In addition, the autonomous control unit 30C calculates a control value so to move the bucket 6 along the tilt part SL, namely, so as to move the bucket 6 in the diagonally upward direction designated by an arrow AR3. Specifically, the autonomous control unit 30C calculates a control value so as to have the control reference point Pb come into contact with the tilt part SL at the excavation angle θ.

In this way, in the example in FIG. 8A, until the control reference point Pa3 comes into contact the tilt part SL, the autonomous control unit 30C calculates a control value based on the control reference point Pb. In addition, once the control reference point Pa3 comes into contact the tilt part SL, the autonomous control unit 30C switches the control reference point as the reference upon calculation of the control value, from the control reference point Pb to the control reference point Pa, and based on the control reference point Pa, calculates a control value. This is because the closest point with respect to the target surface TS is switched from the control reference point Pb to the control reference point Pa. Also at this time, the autonomous control unit 30C attempts to move the bucket 6 along the target surface TS, as shown with the bucket 6 designed by the dotted line, immediately after the third point of time, the autonomous control unit 30C cannot prevent the teeth end of the bucket 6 from cutting into the target surface TS. This is because the bucket 6 moves to the right side in the horizontal direction by inertia, even if the contents of control change suddenly due to the switching of the nearest point. In other words, this is because the autonomous control unit 30C cannot cause change in position of the bucket 6 at the teeth end to follow change in the target surface TS (change from the horizontal part HS to the tilt part SL).

In contrast, in the example in FIG. 8B, the autonomous control unit 30C is configured to cause the excavation attachment AT to operate autonomously with control values derived based on the respective predicted positions of the two control reference points. Specifically, in the example in FIG. 8B, the autonomous control unit 30C causes the excavation attachment AT to operate autonomously with the synthesized control values that is obtained by synthesizing the control values derived from the predicted position of the control reference point Pa with the control values derived from the predicted position of the control reference point Pb. In other words, the example in FIG. 8B is based on two control reference points, and based on a predicted position instead of a current position of a control reference point, and in these regards, differs from the example in FIG. 8A.

The predicted position of the control reference point means a position of the control reference point after a predetermined time, predicted from the current position of the control reference point. The predetermined time is, for example, a time corresponding to one or more control cycles. However, the autonomous control unit 30C may be configured to cause the excavation attachment AT to operate autonomously with control values derived based on the respective current positions of the two control reference points. Note that in the example in FIG. 8B, the predicted position of the control reference point is calculated based on the current position of the control reference point, and the amount of operation of the left operation lever 26L in the arm closing direction.

More specifically, at the first point of time, similar to the case of the example in FIG. 8A, the autonomous control unit 30C calculates a control value so as to move the bucket 6 in the horizontal direction designated by an arrow AR11. However, at the second point of time, unlike the case of the example in FIG. 8A, the autonomous control unit 30C calculates a control value so as to move the bucket 6 in the diagonally upward direction designated by an arrow AR12. This is because the autonomous control unit 30C calculates a final control value, by synthesizing the control values calculated based on the control reference point Pa2 with the control values calculated based on the control reference point Pb2. Note that the control values calculated based on the control reference point Pb2 are control values that move the bucket 6 in the horizontal direction designated by a dotted arrow AR12*a*, and the control values calculated based on the control reference point Pa2 is control values that move the bucket 6 in the diagonally upward direction designated by a dotted arrow AR12*b*. In the example in FIG. 8B, the direction designated by the dotted arrow AR12*a* is different from the direction designated by the dotted arrow AR12*b*; therefore, the autonomous control unit 30C is configured to calculate a final control value, so as to make the control value for moving the bucket 6 in the direction designated by the dotted arrow AR12*a* smaller. However, even in such a case, the autonomous control unit 30C may be configured to calculate a final control value, so as not to make the control value for moving the bucket 6 in the direction designated by the dotted arrow AR12*a* smaller.

In this way, in the example in FIG. 8B, the autonomous control unit 30C calculates the control values continuously and individually based on each of the control reference point Pa and the control reference point Pb, and then, synthesizes these two control values to derive the final control value. Therefore, compared to the example in FIG. 8A, the autonomous control unit 30C can incorporate, relatively earlier, the effect of the control values calculated based on the control reference points other than the control reference point closest to the target surface TS. Therefore, the autonomous control unit 30C can cause change in position of the bucket 6 at the teeth end to follow change in the target surface TS. In a strict sense, the autonomous control unit 30C can change the position of the teeth end of the bucket 6 prior to the change in the target surface TS. As a result, immediately after the third point of time, the autonomous control unit 30C can prevent the teeth end of the bucket 6 from cutting into the target surface TS.

Figure 9:
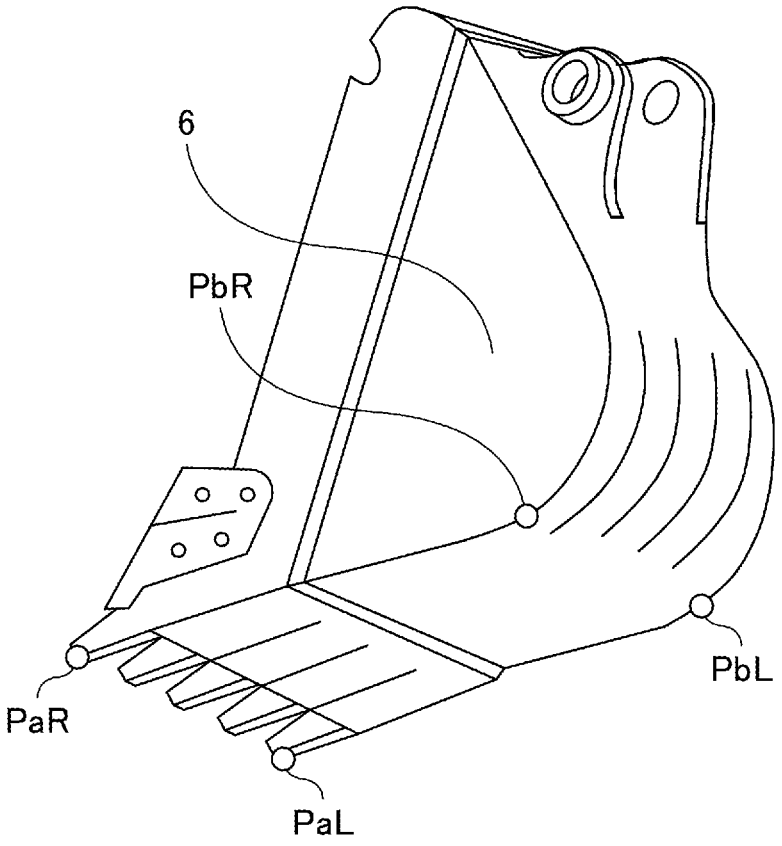
FIG. 9 is a perspective view of a bucket.

Next, with reference to FIG. 9, another example of setting control reference points in the bucket 6 will be described. FIG. 9 is a perspective view of the back face of the bucket 6. Instead of calculating the control values based on each of the control reference point Pa and the control reference point Pb as described above, the autonomous control unit 30C may be configured to calculate the control values based on each of the four control reference points as illustrated in FIG. 9.

The four control reference points include control reference points PaL, PaR, PbL, and PbR. The control reference point PaL is set to the left edge of the teeth end of the bucket 6. The control reference point PaR is set to the right edge of the teeth end of the bucket 6. The control reference point PbL is set to the left edge of the back face of the bucket 6. The control reference point PbR is set to the right edge of the back face of the bucket 6.

In this case, for example, the autonomous control unit 30C may be configured to cause the excavation attachment AT to operate autonomously with control values derived based on the respective current positions or predicted positions of the four control reference points, based on the control value obtained by synthesis. Alternatively, the autonomous control unit 30C may be configured to cause the excavation attachment AT to operate autonomously with control values derived based on the respective current positions or predicted positions of the three, five or greater control reference points, based on the control value obtained by synthesis. For example, the control reference point may include the control reference points PaL, PaR, PbL, and PbR; the control reference point set at the central edge of the back face of the bucket 6; and the control reference point set at the central edge of the teeth end of the bucket 6.

Also, based on the information on the shovel 100 or the information on the target surface TS, the autonomous control unit 30C may dynamically determine the number of control reference points used for calculating the control values. In other words, the autonomous control unit 30C may dynamically determine which control reference point is used from among the multiple control reference points. For example, in the case where it is determined that shovel 100 is positioned on a tilt ground, the autonomous control unit 30C may be configured to calculate a control value based on each of the four control reference point PaL, PaR, PbL, and PbR; or in the case where it is determined that shovel 100 is positioned on a flat ground, the autonomous control unit 30C may be configured to calculate control values based on each of the two control reference points PaL and PbL. In this case, the autonomous control unit 30C may determine whether the shovel 100 is positioned on a tilt ground or positioned on a flat ground, based on the output of the machine tilt sensor S4.

Further, during a revolution operation, the autonomous control unit 30C may dynamically determine which control reference point is used from among the multiple control reference points. For example, in the case where it is determined that the revolution operation is in progress, the autonomous control unit 30C may calculate a control value based on each of the four control reference point PaL, PaR, PbL, and PbR. Alternatively, in the case where it is determined that the revolution operation is stopped, the autonomous control unit 30C may be configured to calculate a control value based on each of the two control reference point PaL and PbL. In this case, the autonomous control unit 30C may determine whether the revolution operation is in progress or the revolution is stopped, based on at least one of the amount of the lever operation in the left-and-right direction (revolution direction) of the left operation lever 26L; pilot pressure working on the pilot port of the control valve 173; pressure of hydraulic oil in the hydraulic motor for revolution 2A; a detected value of the revolutional angular velocity sensor S5; and the like.

With this configuration, when slope face finishing work using the machine control functions is performed, for example, in a state of the shovel 100 not squarely facing the slope face, the autonomous control unit 30C can prevent the teeth end of the bucket 6 from cutting into the slope face more securely.

Figure 10:
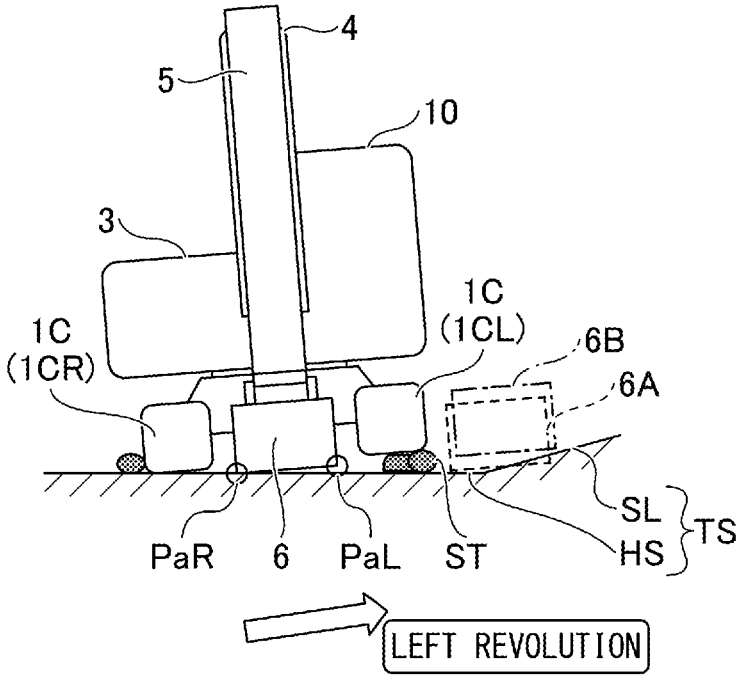
FIG. 10 is a front view of a bucket moving along a target surface.

Next, with reference to FIG. 10, effects of using the four control reference point PaL, PaR, PbL, and PbR illustrated in FIG. 9 will be described. FIG. 10 is a front view of the shovel 100.

In the example illustrated in FIG. 10, the right crawler 1CR is positioned on the horizontal plane, and the left crawler 1CL is positioned on a stone ST on the horizontal plane. Therefore, the shovel 100 is tilted with the right side down. In addition, the operator is attempting to move the teeth end of the bucket 6 along the target surface TS by a left revolution. The target surface TS has a horizontal part HS and a tilt part SL, and is an upward slope toward the left.

In this case, once the autonomous control unit 30C calculates the control values based only on a control reference point PaR contacting the horizontal part HS, when the left operation lever 26L is operated in the left revolution direction to move the bucket 6 to the left, the control reference point PaL comes into contact with the tilt part SL, and damages the target surface TS. A bucket 6A designated by a broken line in FIG. 10 represents a state of the bucket 6 when the left edge of the teeth end of the bucket 6 cuts into the tilt part SL of the target surface TS.

Thereupon, the autonomous control unit 30C calculates a control value based on each of the four control reference point PaL, PaR, PbL, and PbR, for example, based on the output of the machine tilt sensor S4, in the case where it is determined that the shovel 100 is tilted with the right side down.

Alternatively, for example, in the case where it is determined that a revolution operation is being performed based on the output of the operation pressure sensor 29LB, the autonomous control unit 30C calculates a control value based on each of the four control reference point PaL, PaR, PbL, and PbR. In this case, the autonomous control unit 30C may calculate a control value based on each of the four control reference point PaL, PaR, PbL, and PbR, regardless of whether the shovel 100 is tilted or not.

Alternatively, in the case where it is determined that a left revolution operation is being performed based on the output of the operation pressure sensor 29LB, the autonomous control unit 30C may calculate control values based on at least one of the control reference points PaL and PbL. This is because the control reference points PaL and PbL are located at leading positions in the revolution direction. Similarly, in the case where it is determined that a right revolution operation is being performed based on the output of the operation pressure sensor 29LB, the autonomous control unit 30C may calculate control values based on at least one of the control reference points PaR and PbR. This is because the control reference points PaR and PbR are located at leading positions in the revolution direction.

Note that the autonomous control unit 30C may calculate control values based on each of the two control reference points PaL and PaR among four points, in the case of not causing the back face of the bucket 6 to contact the target surface TS.

With this configuration, even in the case where the bucket 6 moves to the left, the autonomous control unit 30C can prevent the control reference point PaL (the left edge of the teeth end of the bucket 6) from cutting into the tilt part SL of the target surface TS. A bucket 6B designated by a broken line in FIG. 10 represents a state of the bucket 6 when the left edge of the teeth end of the bucket 6 is lifted slightly upward, not so as to cut into the tilt part SL of the target surface TS.

Figure 11:
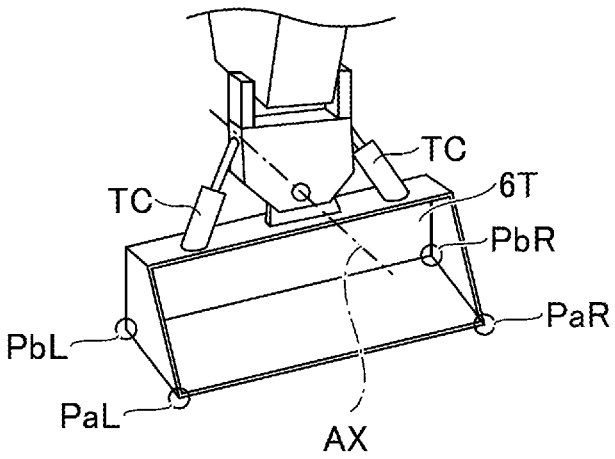
FIG. 11 is a perspective view of a tilt bucket.

Next, with reference to FIG. 11, examples of setting control reference points in a tilt bucket 6T will be described. FIG. 11 is a perspective view of the tilt bucket 6T as viewed from the cabin 10. As in the case of FIG. 9, the autonomous control unit 30C may be configured to calculate a control value based on each of the four control reference points.

The four control reference point includes control reference points PaL, PaR, PbL, and PbR. The control reference point PaL is set to the left edge of the teeth end of the tilt bucket 6T. The control reference point PaR is set to the right edge of the teeth end of the tilt bucket 6T. The control reference point PbL is set to the left edge of the back face of the tilt bucket 6T. The control reference point PbR is set to the right edge of the back face of the tilt bucket 6T.

In the example illustrated in FIG. 11, the controller 30 can tilt the tilt bucket 6T around the tilt axis AX, by extending or contracting each of a pair of tilt cylinders TC on the left and right separately. Note that only one tilt cylinder TC may be attached to the tilt shaft AX on the left side, or only one tilt cylinder TC may be attached to the tilt shaft AX on the right side.

Figure 12:
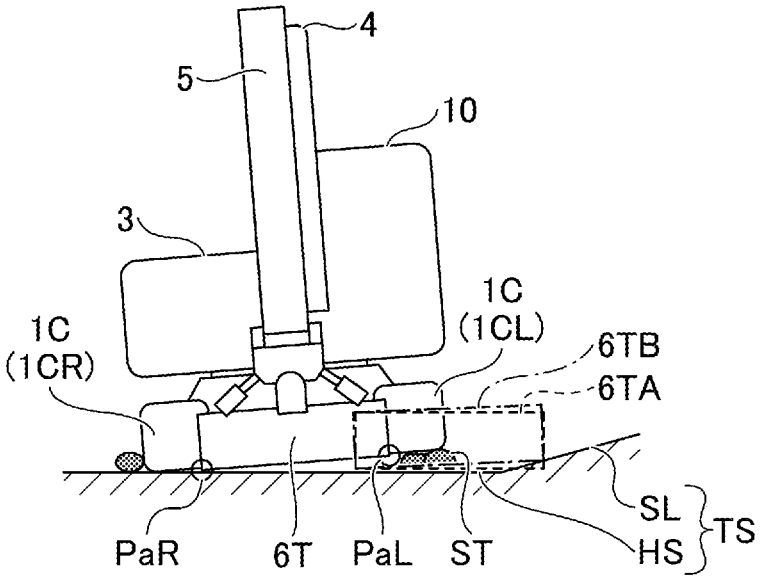
FIG. 12 is a front view of a tilt bucket moving along a target surface.

Next, with reference to FIG. 12, effects of using the four control reference point PaL, PaR, PbL, and PbR illustrated in FIG. 11 will be described. FIG. 12 is a front view of the shovel 100, which corresponds to FIG. 10.

In the example illustrated in FIG. 12, as in the case of FIG. 10, the right crawler 1CR is positioned on the horizontal plane, and the left crawler 1CL is positioned on a stone ST on the horizontal plane. Therefore, the shovel 100 is tilted with the right side down. In addition, the operator is attempting to move the back face of the tilt bucket 6T along the target surface TS by a left revolution. The target surface TS has a horizontal part HS and a tilt part SL, and is an upward slope toward the left.

In this case, once the autonomous control unit 30C calculates the control values based only on a control reference point PaR contacting the horizontal part HS, when the left operation lever 26L is operated in the left revolution direction to move the tilt bucket 6T to the left, the control reference point PaL comes into contact with the tilt part SL, and damages the target surface TS. A tilt bucket 6TA designated by a broken line in FIG. 12 represents a state of the tilt bucket 6T when the left edge of the teeth end of the tilt bucket 6T cuts into the tilt part SL of the target surface TS.

Thereupon, for example, based on the output of the machine tilt sensor S4, in the case where it is determined that the shovel 100 is tilted with the right side down, the autonomous control unit 30C causes the tilt bucket 6T to tilt around the tilt axis AX so that both the left edge and the right edge of the teeth end of the tilt bucket 6T comes into contact with the target surface TS. Here, the autonomous control unit 30C causes the tilt bucket 6T to tilt around the tilt axis AX, so as to make the back face of the tilt bucket 6T parallel to the horizontal part HS of the target surface TS.

In addition, the autonomous control unit 30C calculates a control value based on each of the four control reference point PaL, PaR, PbL, and PbR.

Alternatively, for example, in the case where it is determined that a revolution operation is being performed based on the output of the operation pressure sensor 29LB, the autonomous control unit 30C calculates a control value based on each of the four control reference point PaL, PaR, PbL, and PbR. In this case, the autonomous control unit 30C may calculate a control value based on each of the four control reference point PaL, PaR, PbL, and PbR, regardless of whether the shovel 100 is tilted or not.

Alternatively, in the case where it is determined that a left revolution operation is being performed based on the output of the operation pressure sensor 29LB, the autonomous control unit 30C may calculate control values based on at least one of the control reference points PaL and PbL. This is because the control reference points PaL and PbL are located at leading positions in the revolution direction. Similarly, in the case where it is determined that a right revolution operation is being performed based on the output of the operation pressure sensor 29LB, the autonomous control unit 30C may calculate control values based on at least one of the control reference points PaR and PbR. This is because the control reference points PaR and PbR are located at leading positions in the revolution direction.

Note that the autonomous control unit 30C may calculate control values based on each of the two control reference points PaL and PaR, in the case of not causing the back face of the tilt bucket 6T to contact the target surface TS. In other words, the autonomous control unit 30C may calculate a control value, without based on the remaining two control reference points PbL and PbR.

With this configuration, even in the case where the tilt bucket 6T moves to the left, the autonomous control unit 30C can prevent the control reference point PaL (the left edge of the teeth end of the tilt bucket 6T) from cutting into the tilt part SL of the target surface TS. A tilt bucket 6TB designated in FIG. 12 by a one-dot chain line, illustrates a state of the tilt bucket 6T, when the right edge of the teeth end of the tilt bucket 6T is coincident with the horizontal part HS of the target surface TS, and the left edge of the teeth end of the tilt bucket 6T is tilted around the tilt axis AX to be coincident with the tilt part SL of the target surface TS.

Figure 13:
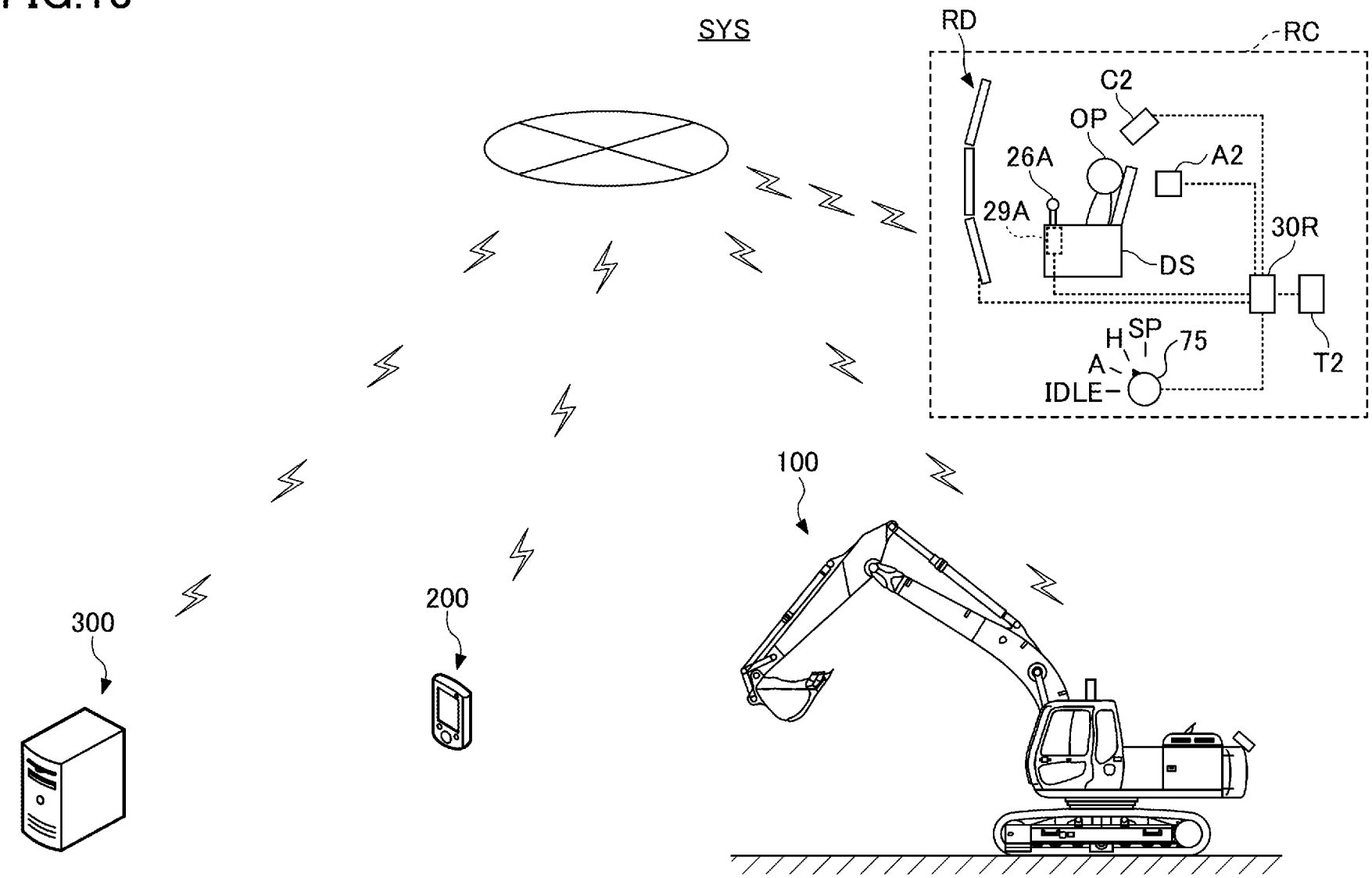
FIG. 13 is a schematic view illustrating an example of a construction system.

Next, with reference to FIG. 13, a construction system SYS will be described. FIG. 13 is a schematic view illustrating an example of a construction system SYS. As illustrated in FIG. 13, the construction system SYS includes a shovel 100, a support device 200, and a management device 300. The construction system SYS is configured to assist construction work using one or more units of the shovel 100.

Information obtained by the shovel 100 may be shared with a manager, other shovel operators, and the like through the construction system SYS. The numbers of the shovels 100, the support devices 200, and the management devices 300 constituting the construction system SYS may be one or more, respectively. In the example illustrated in FIG. 13, the construction system SYS includes one unit of shovel 100, one unit of support device 200, and one unit of management device 300.

The support device 200 is typically a mobile terminal device such as a laptop computer terminal, a tablet terminal, or a smartphone carried, for example, by a worker at a construction site. The support device 200 may be a mobile terminal carried by the operator of the shovel 100. The support device 200 may be a fixed terminal device.

The management device 300 is typically a fixed terminal device, for example, a server computer (what is called a cloud server) installed at a management center outside the construction site. Also, the management device 300 may be, for example, an edge server set at the construction site. Also, the management device 300 may be a portable terminal device (e.g., a laptop computer terminal, a tablet terminal, or a mobile terminal such as a smartphone).

At least one of the support device 200 and the management device 300 may be equipped with a monitor and an operation device for remote control. In this case, the operator using the support device 200 or the management device 300 may operate the shovel 100 while using an operation device for remote control operation. The operation device for remote control operation is communicably connected to the controller 30 installed on the shovel 100 via, for example, a wireless communication network such as a short-range wireless communication network, cellular telephone communication network, satellite communication network, or the like.

Also, various informative images (e.g., image information representing the appearance of the surroundings of the shovel 100, various setting screens, and the like) displayed on the display device D1 installed in the cabin 10 may be displayed on a display device connected to at least one of the support device 200 and the management device 300. The image information representing the appearance of the surroundings of the shovel 100 may be generated based on images captured by an imaging device (e.g., a camera as a space recognition device 70). This enables a worker using the support device 200, a manager using the management device 300, or the like to perform remote control operation of the shovel 100, or to make various settings related to the shovel 100, while confirming the appearance of the surroundings of the shovel 100.

For example, in the construction system SYS, the controller 30 of the shovel 100 may transmit information on at least one of the following items to at least one of the support device 200 and the management device 300: time and place when the switch NS was pressed; a target trajectory used when the shovel 100 operates autonomously; and a trajectory actually traced by a predetermined part during the autonomous operation; and the like. At this time, the controller 30 may transmit images captured by the imaging device to at least one of the support device 200 and the management device 300. The captured images may include multiple images captured during the autonomous operation. Further, the controller 30 may transmit information on at least one of the following items to at least one of the support device 200 and the management device 300: data related to the contents of the operation of the shovel 100 during the autonomous operation; data related the positions of the shovel 100; data related the position of the excavation attachment: and the like. This enables a worker using the support device 200 or a manager using the management device 300 can obtain information on the shovel 100 during the autonomous operation.

In this way, in the support device 200 or the management device 300, the type and position of objects to be monitored outside the monitoring range of the shovel 100 are stored in the storage unit in time series. Here, what is stored (information) in the support device 200 or the management device 300, may be the types and positions of objects to be monitored outside the monitoring range of the shovel 100, and within the monitoring range of another shovel.

In this way, the construction system SYS allows information on the shovel 100 to be shared with the manager and the operator of the other shovel.

Note that as illustrated in FIG. 13, a communication device installed on the shovel 100 may be configured to transmit and receive information with a communication device T2 installed in a remote control operation room RC via wireless communication. In the example illustrated in FIG. 13, the communication device installed on the shovel 100 and the communication device T2 are configured to transmit and receive information via a fifth generation mobile communication channel (5G channel), an LTE channel, a satellite channel, or the like.

In the remote control operation room RC, a remote controller 30R, a sound output device A2, an indoor imaging device C2, a display device RD, a communication device T2, and the like are installed. Also, in the remote control operation room RC, a driver's seat DS to be seated by an operator OP who remotely operates the shovel 100 is provided.

The remote controller 30R is an arithmetic/logic device that executes various operations. In the present embodiment, like the controller 30, the remote controller 30R is constituted with a microcomputer including a CPU and a memory. In addition, the various functions of the remote controller 30R are implemented by the CPU executing a program stored in the memory.

The sound output device A2 is configured to output sound. In the present embodiment, the sound output device A2 is a speaker, and is configured to reproduce sound collected by a sound collecting device (not illustrated) attached to the shovel 100.

The indoor imaging device C2 is configured to capture images in the remote control operation room RC. In the present embodiment, the indoor imaging device C2 is a camera installed inside the remote control operation room RC, and is configured to capture images of the operator OP sitting on the driver seat DS.

The communication device T2 is configured to control wireless communication with the communication device attached to the shovel 100.

In the present embodiment, the driver's seat DS has a similar structure to that of the driver's seat installed in the cabin of a normal shovel. Specifically, a left console box is arranged on the left side of the driver's seat DS, and a right console box is arranged on the right side of the driver's seat DS. In addition, a left operation lever is arranged on the front end of the top surface of the left console box, and a right operation lever is arranged on the front end of the top surface of the right console box. Also, a traveling lever and a traveling pedal are arranged in front of the driver's seat DS. Further, a dial 75 is arranged in the center of the top surface of the right console box. The left operation lever, the right operation lever, the traveling lever, the traveling pedal, and the dial 75 constitute an operation device 26A.

The dial 75 is a dial for adjusting the number of revolutions of the engine 11, and is configured to be capable of switching the number of revolutions of the engine, for example, in four stages.

Specifically, the dial 75 is configured to be capable of switching the number of revolutions of the engine in the four stages of SP mode, H mode, A mode, and idling mode. The dial 75 transmits data related to the setting of the number of revolutions of the engine to the controller 30.

The SP mode is a mode of the number of revolutions selected in the case where the operator OP wants to prioritize the work rate, and uses the highest number of revolutions of the engine. The H mode is a mode of the number of revolutions selected in the case where the operator OP wants to balance the work rate and the fuel efficiency, and uses the second highest number of revolutions of the engine. The A mode is a mode of the number of revolutions selected in the case where the operator OP wants to operate the shovel with low noise while prioritizing the fuel economy, and uses the third highest number of revolutions of the engine. The idling mode a mode of the number of revolutions selected in the case where the operator OP wants to shift the engine into an idling state, and uses the lowest number of revolutions of the engine. In addition, the number of revolutions of the engine 11 is controlled to be constant at a number of revolutions of the engine corresponding the mode selected via the dial 75.

In the operation device 26A, an operation sensor 29A is installed for detecting the contents of an operation performed on the operation device 26A. The operation sensor 29A is, for example, a tilt sensor to detect the tilt angle of the operation lever, an angle sensor for detecting the swing angle around the swing axis of the operation lever, or the like. The operation sensor 29A may be constituted with another sensor such as a pressure sensor, a current sensor, a voltage sensor, or a distance sensor, or the like. The operation sensor 29A outputs information on the contents of the detected operation performed on the operation device 26A, to the remote controller 30R. The remote controller 30R generates an operation signal based on the received information, and transmits the generated operation signal to the shovel 100. The operation sensor 29A may be configured to generate an operation signal. In this case, the operation sensor 29A may output the operation signal to the communication device T2 without going through the remote controller 30R.

The display device RD is configured to display information on the situation of the surroundings of the shovel 100. In the present embodiment, the display device RD is a multi-display constituted with nine monitors arrayed in three rows vertically and three columns horizontally, and is configured to be capable of displaying the appearances of the forward, leftward, and rightward spaces of the shovel 100. Each of the monitors is a liquid crystal monitor, an organic EL monitor, or the like. However, the display device RD may be constituted with one or more curved monitors, and may be constituted with a projector.

The display device RD may be a display device wearable by the operator OP. For example, the display device RD may be a head-mounted display, and may be configured to be capable of transmitting and receiving information with the remote controller 30R via wireless communication. The head mount display may be connected to the remote controller by wire. The head mount display may be a transparent head mount display, or may be a non-transparent head mount display. The head mount display may be a monocular head mount display, or may be a binocular head mount display.

The display device RD is configured to display images, with which the operator OP in the remote control operation room RC can visually recognize the surroundings of the shovel 100. In other words, the display device RD displays the images such that the situation of the surroundings of the shovel 100 can be confirmed, as if in the cabin 10 of the shovel 100, even though the operator is actually in the remote control operation room RC.

Figure 14:
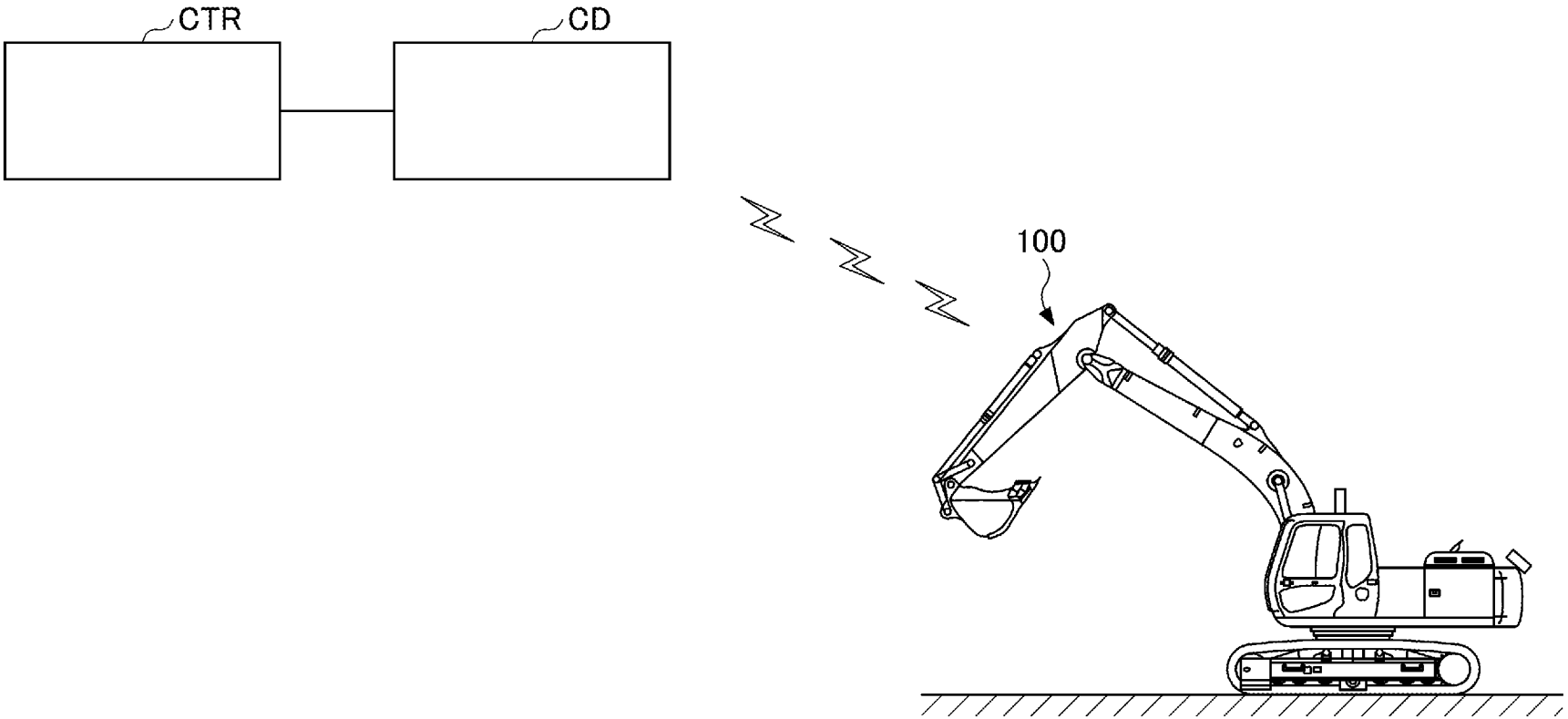
FIG. 14 is a schematic view illustrating another example of a construction system.

Next, with reference to FIG. 14, another configuration example of the construction system SYS will be described. In the example illustrated in FIG. 14, the construction system SYS is configured to assist construction work using the shovel 100. Specifically, the construction system SYS includes a communication device CD to execute communication with the shovel 100, and a control device CTR. The control device CTR is configured to include a first control unit to cause the actuators of the shovel 100 to operate autonomously, and a second control unit to cause the actuators to operate autonomously. In addition, in the case where it is determined that there is a conflict among the multiple control units, the control device CTR is configured to select one of the multiple control units including the first control unit and the second control unit, as a control unit prioritized over the others in operation. Note that although the first control unit and the second control unit are illustrated distinctively for the sake of convenience of the description, these do not need to be physically distinctive, and may be constituted entirely or partially with common software components or hardware components.

As described above, the shovel 100 according to the present disclosure includes the traveling lower body 1, the revolving upper body 3 installed in traveling lower body 1 to be capable of revolving, the attachment attached to the revolving upper body 3, the end attachment that constitutes the attachment, the actuators that moves the attachment, and the controller 30 as the control device that causes the actuators to operate autonomously. In addition, the controller 30 is configured to calculate a control value for each actuator for each of multiple predetermined points (control reference points) on the end attachment, based on the calculated control values, to cause the actuators to operate autonomously. With this configuration, when work using the machine control functions is performed, the shovel 100 can prevent damage of the target surface TS caused by the end attachment more securely.

The end attachment is typically the bucket 6. In this case, the multiple control reference points in bucket 6 may be one point on the teeth end of the bucket 6, and may be one point on the back face of the bucket 6. Alternatively, as illustrated in FIG. 9, the multiple control reference points in bucket 6 may include a left end point and a right end point of the teeth end of the bucket 6, and a left end point and a right end point of the back face of the bucket 6. With this configuration, when work using the machine control functions is performed, the shovel 100 can prevent damage of the target surface TS caused by the bucket 6 more securely.

For example, the controller 30 may be configured to synthesize the control values to calculate a synthesized control value and based on the synthesized control value, causes the actuators to operate autonomously. With this configuration, the controller 30 can reflect more appropriately the control values calculated based on the control reference points other than the control reference point closest to the target surface TS, in the synthesized control value, and thereby, can prevent damage of the target surface TS caused by the bucket 6 more securely.

The controller 30 may be configured to calculate a control value of each actuator corresponding to each of the multiple control reference points, based on change in distance between each of the control reference points and the target surface. For example, when synthesizing the control values to calculate a synthesized control value, the controller 30 may be configured to reflect most significantly the effect of the control values for a control reference point with the greatest change in distance from among the multiple control reference points, in the synthesized control value. With this configuration, the controller 30 can prioritize a control reference point that is most likely to inadvertently cut into the target surface TS from among the multiple control reference points, to reflect the control value calculated based on the control reference point in the synthesized control value, and thereby, can prevent damage of the target surface TS caused by the bucket 6 more securely.

The controller 30 may be configured to predict respective positions of the multiple control reference points after a predetermined time, and based on the positions after the predetermined time, calculate a control value of each of the actuators for each of the multiple control reference points. With this configuration, the controller 30 can determine further earlier whether each of the control reference points is likely to cut into the target surface TS, and thereby, can prevent damage of the target surface TS caused by the bucket 6 more securely.

As described above, favorable embodiments according to the present invention have been described in detail. However, the present invention is not restricted to the embodiments described above. Various modifications, substitutions, and the like may be applied to the embodiments described above without deviating from the scope of the present invention. Also, the separately described features can be combined unless a technical inconsistency is introduced.

For example, in the embodiment described above, the predicted position of the control reference point means a position of the control reference point after a predetermined time, predicted from the current position of the control reference point; and the predetermined time is set to, for example, a time corresponding to one or more control cycles. In other words, the predetermined time is assumed to be a time within a range of tens of milliseconds to hundreds of milliseconds. However, the predetermined time may be one second or longer. Also, the autonomous control unit 30C may be configured to use model prediction control using an observer (state observer) to cause the shovel 100 to operate autonomously.

What is claimed is:

1. A shovel comprising:

a traveling lower body;

a revolving upper body installed on the traveling lower body, to be capable of revolving;

an attachment attached to the revolving upper body;

an end attachment constituting the attachment;

an actuator; and a control device including a memory and a processor configured to cause the actuator to operate autonomously, wherein the control device calculates a control value of the actuator for each of a plurality of predetermined points on the end attachment, and based on the calculated control values, causes the actuator to operate autonomously, wherein the end attachment is a bucket, and wherein the plurality of predetermined points include a left end point and a right end point of a teeth end of the bucket.

2. The shovel as claimed in claim 1, wherein the end attachment is a bucket, and wherein the plurality of predetermined points include a left rear end point and a right rear end point of a back face of the bucket.

3. The shovel as claimed in claim 1, wherein the control device synthesizes control values to calculate a synthesized control value, and based on the synthesized control value, causes the actuator to operate autonomously.

4. The shovel as claimed in claim 1, wherein the control device calculates the control value of the actuator for said each of the plurality of predetermined points, based on change in distance between said each of the plurality of predetermined points and a target surface set in advance.

5. The shovel as claimed in claim 1, wherein the control device predicts respective positions of the plurality of predetermined points after a predetermined time, and based on the positions after the predetermined time, calculates the control value of the actuator for said each of the plurality of predetermined points.

6. The shovel as claimed in claim 1, wherein the control device uses at least one control value selected from among the control values based on a predetermined condition, to cause the actuator to operate autonomously.

7. A construction system that assists construction work using a shovel including a traveling lower body, a revolving upper body installed on the traveling lower body, to be capable of revolving, an attachment attached to the revolving upper body, an end attachment constituting the attachment, and an actuator, the construction system comprising:

a communication device configured to communicate with the shovel; and a control device including a memory and a processor, wherein the control device calculates a control value of the actuator for each of a plurality of predetermined points on the end attachment, and based on the calculated control values, outputs a command to cause the actuator to operate autonomously, to the shovel via the communication device, wherein the end attachment is a bucket, and wherein the plurality of predetermined points include a left end point and a right end point of a teeth end of the bucket.

8. The construction system as claimed in claim 7, wherein the end attachment is a bucket, and wherein the plurality of predetermined points include a left end point and a right end point of a teeth end of the bucket, and a left rear end point and a right rear end point of a back face of the bucket.

9. The construction system as claimed in claim 7, wherein the control device synthesizes control values to calculate a synthesized control value, and based on the synthesized control value, causes the actuator to operate autonomously.

10. The construction system as claimed in claim 7, wherein the control device calculates the control value of the actuator for said each of the plurality of predetermined points, based on change in distance between said each of the plurality of predetermined points and a target surface set in advance.

11. The construction system as claimed in claim 7, wherein the control device predicts respective positions of the plurality of predetermined points after a predetermined time, and based on the positions after the predetermined time, calculates the control value of the actuator for said each of the plurality of predetermined points.

12. The construction system as claimed in claim 7, wherein the control device uses at least one control value selected from among the control values based on a predetermined condition, to cause the actuator to operate autonomously.

13. The shovel as claimed in claim 2, wherein the control device calculates a first control value of the actuator based on at least one of the left end point and the right end point of the teeth end of the bucket, and a second control value of the actuator based on at least one of the left rear end point and the right rear end point of the back face of the bucket, and wherein the control device synthesizes the first control value and the second control value to calculate a synthesized control value, and based on the synthesized control value, causes the actuator to operate autonomously.

* * * * *